US008668199B2

(12) United States Patent
Abe et al.

(10) Patent No.: US 8,668,199 B2
(45) Date of Patent: Mar. 11, 2014

(54) SHEET CONVEYANCE APPARATUS AND IMAGE FORMING SYSTEM

(71) Applicant: Canon Kabushiki Kaisha, Tokyo (JP)

(72) Inventors: Hideto Abe, Toride (JP); Hideki Kushida, Moriya (JP); Toshiyuki Iwata, Abiko (JP); Yohei Gamo, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/835,782

(22) Filed: Mar. 15, 2013

(65) Prior Publication Data

US 2013/0249166 A1 Sep. 26, 2013

(30) Foreign Application Priority Data

Mar. 26, 2012 (JP) ..... 2012-069562

(51) Int. Cl.
*B65H 9/14* (2006.01)
*B65H 9/16* (2006.01)

(52) U.S. Cl.
USPC ..... 271/228; 271/248; 271/249; 271/252; 271/272

(58) Field of Classification Search
USPC ..... 271/228, 248–250, 252, 265.02, 272
See application file for complete search history.

(56) References Cited

U.S. PATENT DOCUMENTS 7,401,776 B2 * 7/2008 Obuchi et al. ..... 271/228
8,346,155 B2 * 1/2013 Iwata ..... 399/407
8,511,665 B2 * 8/2013 Iwata et al. ..... 270/58.31

FOREIGN PATENT DOCUMENTS

JP 2007-001761 A 1/2007

* cited by examiner

*Primary Examiner* — Luis A Gonzalez
(74) *Attorney, Agent, or Firm* — Canon U.S.A., Inc., IP Division

(57) ABSTRACT

A sheet conveyance apparatus includes a shift unit which includes a conveyance roller pair capable of being placed in a contact state and a separation state and configured to convey sheets having an overlapping portion where a rear end portion of a preceding sheet and a front end portion of a following sheet overlap each other. The shift unit is movable in a widthwise direction while conveying the sheets by the conveyance roller pair. The sheet conveyance apparatus moves the shift unit in the widthwise direction when it is determined that the overlapping portion of the sheets has reached the conveyance roller pair.

14 Claims, 24 Drawing Sheets

SHEET CONVEYANCE APPARATUS AND IMAGE FORMING SYSTEM

BACKGROUND OF THE INVENTION

1. Field of the Invention

Aspects of the present invention generally relate to a sheet conveyance apparatus and an image forming system and, in particular, to ones configured to convey imbricate sheets while shifting them.

2. Description of Related Art

Conventionally, in an image forming apparatus such as a copying machine, a laser beam printer, a facsimile apparatus, or a multifunction peripheral including these, a sheet with an image formed thereon is discharged to and stacked on a sheet stacking apparatus. In recent years, as a result of the advent of an office network, it has become general practice for a single image forming apparatus such as a printer or a copying machine to be used by a plurality of users. In the case where a single image forming apparatus is shared by a plurality of users, a sheet bundle may be extracted without any doubt if only one sheet bundle is discharge onto the sheet stacking apparatus or when the number of users who extract the sheet bundle is one. However, the extraction may take time and effort if a plurality of sheet bundles is extracted or if a plurality of users extracts the sheet bundles.

To solve an issue like this, there has been provided a sheet conveyance apparatus which while performing, for example, the conveyance of a sheet, moves the sheet in a widthwise direction orthogonal to the conveyance direction before discharging the sheet onto the sheet stacking apparatus (see Japanese Patent Application Laid-Open No. 2007-001761). By thus discharging the sheet after moving it in the widthwise direction, the sheet is stacked on the sheet stacking apparatus in a state in which it has been shifted in the widthwise direction. Accordingly, it is possible to stack sheets on the sheet stacking apparatus with the sheets shifted for from sheet bundle to sheet bundle and from user to user, so that sheets can be clearly distinguished from one another.

However, in such a conventional sheet conveyance apparatus, when sheets are discharged onto the sheet stacking apparatus while being shifted in succession, it is necessary for a shift unit to move in the widthwise direction from its home position to discharge a sheet and then to return to the home position before the next sheet enters. In the case where the operation of shifting a sheet is thus conducted for each sheet to be conveyed, there is a limitation in terms of productivity.

In order to improve the productivity, in recent years, there has become available an apparatus which is configured to convey sheets with images formed thereon in an imbricate state in which the sheets partially overlap each other in succession. However, when imbricate sheets are shifted, it is impossible to secure the requisite time for the shift unit to return the home position, which means it is impossible to shift the sheets.

The present invention is directed to a sheet conveyance apparatus and an image forming system capable of reliably shifting sheets partially overlapping with each other in the widthwise direction and discharging.

SUMMARY OF THE INVENTION

According to an aspect of the present invention, a sheet conveyance apparatus includes a conveyance roller pair configured to be movable in a widthwise direction orthogonal to a sheet conveyance direction while conveying sheets in a state in which an upstream end portion in the sheet conveyance direction of a preceding sheet and a downstream end portion in the sheet conveyance direction of a following sheet overlap each other, a movement mechanism configured to reciprocate the conveyance roller pair in the widthwise direction, a detection unit provided upstream in the sheet conveyance direction of the conveyance roller pair and configured to detect an overlapping portion where the upstream end portion in the sheet conveyance direction of the preceding sheet and the downstream end portion in the sheet conveyance direction of the following sheet overlap each other, and a control unit configured to control the movement mechanism so as to move the conveyance roller pair in the widthwise direction in a case where it is determined that the sheet overlapping portion has reached the conveyance roller pair based on detection by the detection unit.

According to an exemplary embodiment, the conveyance roller pair holding the overlapping portion of imbricate sheets is moved in the widthwise direction, so that it is possible to reliably shift the sheets in the widthwise direction before discharging them even in the case of sheets partially overlapping each other.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
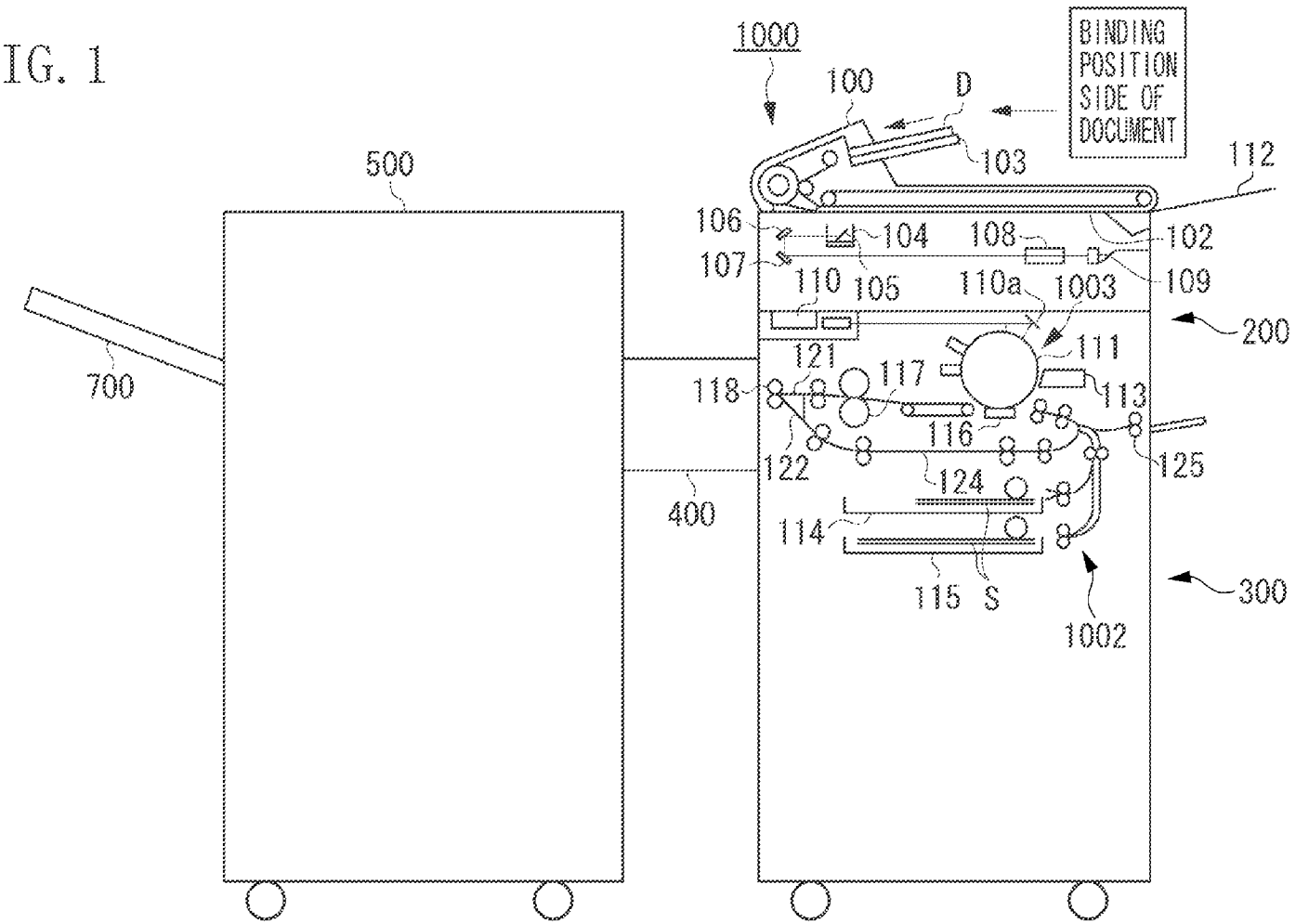
FIG. 1 illustrates a configuration of an image forming apparatus equipped with a sheet processing apparatus according to a first exemplary embodiment.

FIG. 1 illustrates a configuration of an image forming apparatus equipped with a sheet processing apparatus according to a first exemplary embodiment.

In FIG. 1, a printer 1000 is equipped with a printer main body 300 and a scanner 200 arranged on an upper surface of the printer main body 300. The scanner 200 which is configured to read documents is equipped with a document feeding unit 100, a scanner unit 104, a lens 108, an image sensor 109, and the like. When the scanner 200 reads documents D, the documents D are first set on a tray 103 of the document feeding unit 100. At this time, the documents D are set on the tray 103 in a face-up state in which a surface with an image formed thereon faces upwards, and a document stitching position is at a left-hand end portion of the document.

Next, the documents D set on the tray 103 are fed one by one starting from a foremost page to the left (in a direction indicated by an arrow), that is, with the stitching position at the foremost end. Then, the documents D are conveyed from left to right on a platen glass 102 via a curved path. Then, the documents are discharged onto a discharge tray 112.

When the documents D are read through the document flow reading, the scanner unit 104 is retained at a predetermined position, and the documents D pass from left to right above the scanner unit 104, so that the processing of reading the documents D is performed. In the reading processing, when the documents pass on the platen glass 102, the documents D are irradiated with light from a lamp (not illustrated) of the scanner unit 104, and the reflection light from the documents D is guided to an image sensor 109 via mirrors 105 through 107 and a lens 108. Image data of the documents read by the image sensor 109 undergoes predetermined image processing before being sent to exposure control unit 110.

On the other hand, when the documents are read through the document fixed reading, the documents D conveyed by the document feeding unit 100 are temporarily stopped on the platen glass 102, and, in this state, the scanner unit 104 is moved from left to right to perform the document reading processing. Further, in the case where reading of the documents is performed without using the document feeding unit 100, a user raises the document feeding unit 100, and sets the document on the platen glass 102.

The printer main body 300 is equipped with a sheet feeding portion 1002 configured to feed a sheet S accommodated in cassettes 114 and 115, an image forming unit 1003 configured to form an image on the sheet S fed by the sheet feeding unit 1002, and the like. The image forming unit 1003 is equipped with a photosensitive drum 111, a developing device 113, a transfer charger 116, and the like. At the time of image formation, a laser beam from an exposure control unit 110 is applied to the photosensitive drum, and a latent image is formed on the photosensitive drum. The latent image is visualized as a toner image by the developing device 113. On the downstream of the image forming unit 1003, there are arranged a fixing device 117, a discharge roller pair 118, and the like.

Next, the image forming operation performed by the above-described printer main body 300 will be described. First, a document D is read by the image sensor 109 through the document flow reading or the document fixed reading at the scanner 200 as described above. The image data of the documents D is subjected to predetermined image processing and transmitted to the exposure control unit 110. Then, the exposure control unit 110 outputs a laser beam corresponding to the resultant image signal. The output laser beam is applied onto the photosensitive drum 111 while undergoing scanning by a polygon mirror 110*a*. Accordingly, an electrostatic latent image corresponding to the applied laser beam is formed on the photosensitive drum 111. Next, the electrostatic latent image formed on the photosensitive drum 111 is developed by the developing device 113 to be visualized as a toner image.

On the other hand, each sheet S is conveyed from one of the cassettes 114 and 115, a manual sheet-feeding unit 125, and a duplex transport path 124 to a transfer unit formed by the photosensitive drum 111 and the transfer charger 116. Then, the toner image on the photosensitive drum visualized at the transfer unit is transferred to the sheet S. After the transfer, the sheet S is subjected to a fixing processing at the fixing device 117.

Next, the sheet S having passed the fixing device 117 is discharged from the printer main body 300 by the discharge roller pair 118. In the case where the sheet S is discharged from the printer main body 300 in a state in which its surface having the toner image faces downwards (face down state), the sheet S having passed the fixing device 117 is temporarily guided to a path 122 by a switching member (not illustrated).

Then, after the upstream edge of the sheet in the sheet conveyance direction (hereinbelow referred to as the trailing edge) leaves the switching member, the sheet is switched back and conveyed to the discharge roller pair 118. By thus discharging the sheet S face down through the reverse discharge, it is possible to align the page order in the case where image forming processing is performed in succession starting from a first page, for example, when image forming processing is performed on image data from a computer.

In the case where image forming processing is performed on both sides of the sheet S, the sheet S is guided from the fixing device 117 straight toward the discharge roller pair 118, and, immediately after the trailing edge of the sheet has left the switching member, the sheet S is switched back and guided to the duplex transport path 124. In the case where an image is formed on a hard sheet S such as an overhead-projector (OHP) sheet, the sheet S is conveyed from the manual sheet-feeding unit 125. After the image formation, the sheet S is discharged from the printer main body 300 by the discharge roller pair 118 in the state in which its surface having the toner image faces upwards (face-up state) without being guided to the path 122.

Figure 2:
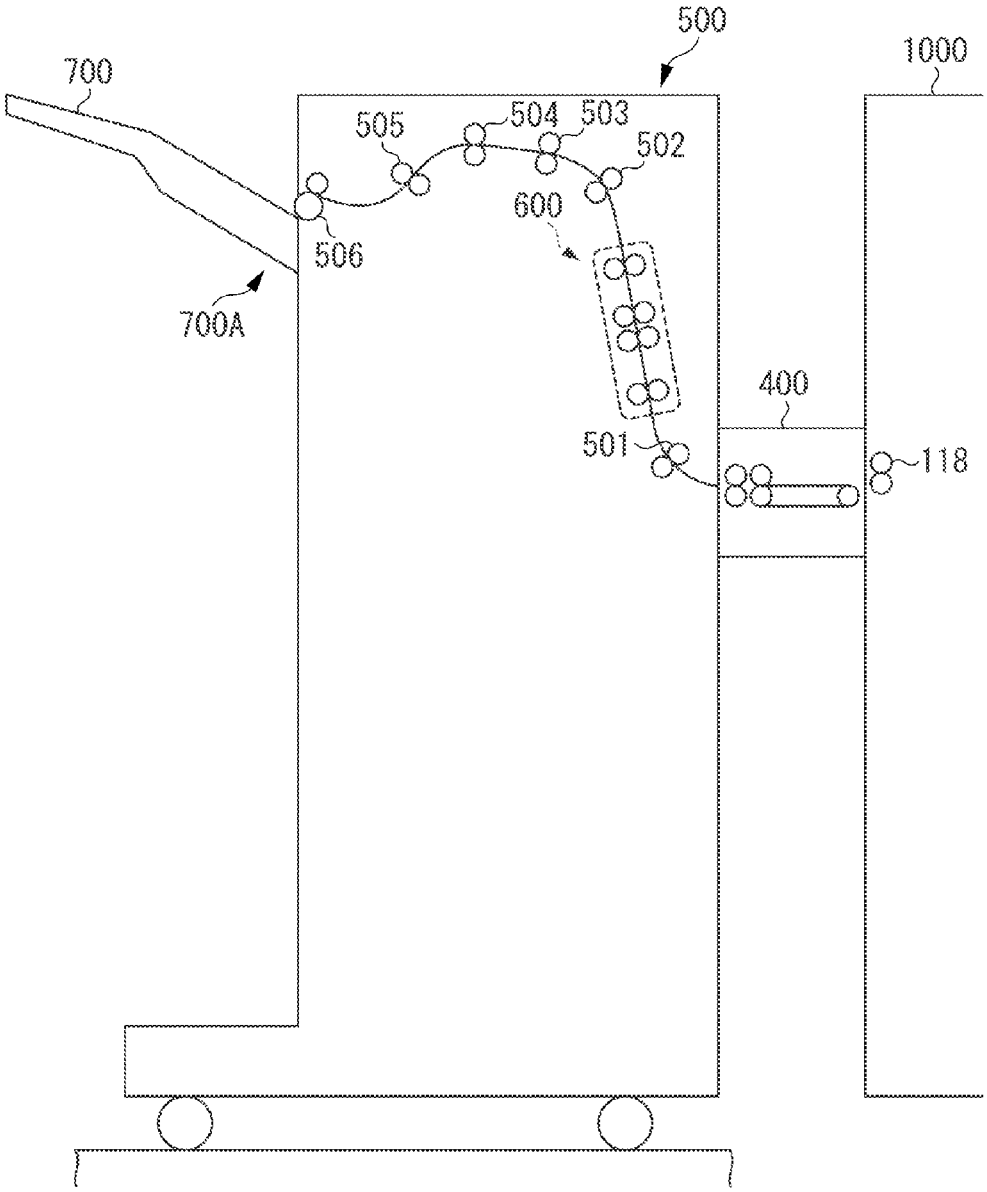
FIG. 2 illustrates a configuration of the above-mentioned sheet processing apparatus and of a sheet overlapping portion.

As illustrated in FIG. 2, the printer main body 300 is connected to a sheet processing apparatus 500 equipped with a sheet overlapping unit 400 and a shift unit 600. The sheet overlapping unit 400 is configured to overlap the sheets which are subjected to image formation and discharged from the printer main body 300 one upon the other. When one sheet bundle is to be discharged, the sheets discharged from the printer main body 300 enter the sheet overlapping unit 400. In the sheet overlapping unit 400, an upstream end portion of a preceding sheet in the sheet conveyance direction (hereinbelow referred to as a rear end portion) and a downstream end portion of a following sheet in the sheet conveyance direction (hereinbelow referred to as a front end portion) are overlapped each other. Then, the overlapped sheets are sent to the shift unit 600 by a conveyance roller pair 501.

Figure 14:
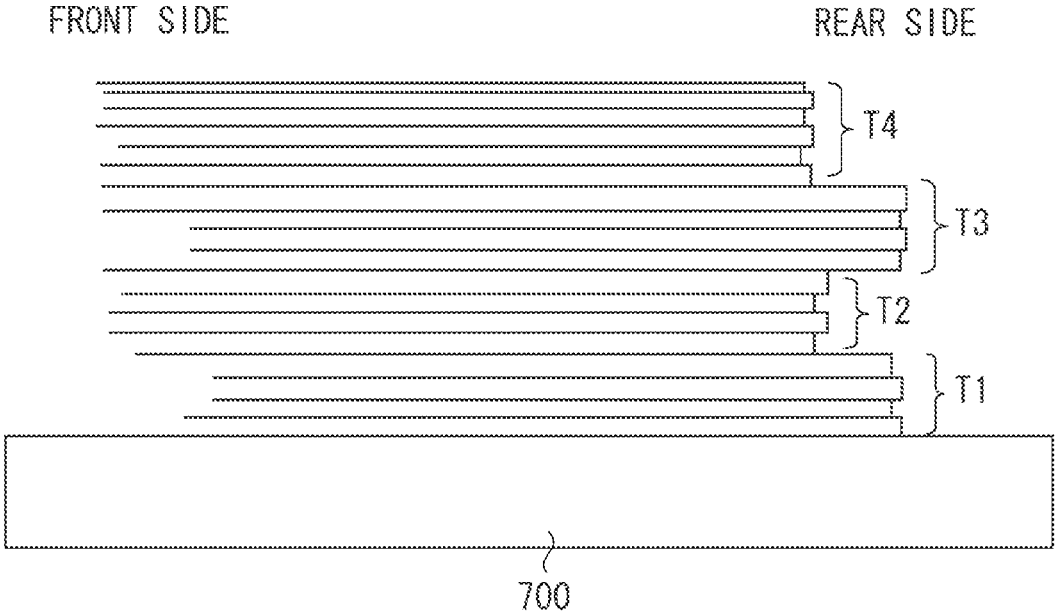
FIG. 14 illustrates how sheet bundles are stacked on a tray of the above-mentioned sheet processing apparatus.

Next, a predetermined shifting operation described below is performed by the shift unit 600, and then the sheets are conveyed to a discharge roller 506 by conveyance roller pairs 502 through 505. Then, the sheets are discharged by the discharge roller 506 constituting the sheet discharge unit, and stacked on a tray 700 described below as illustrated in FIG. 14. According to the present exemplary embodiment, a sheet stacking apparatus 700A is formed by the discharge roller 506 and the tray 700.

Figure 3:
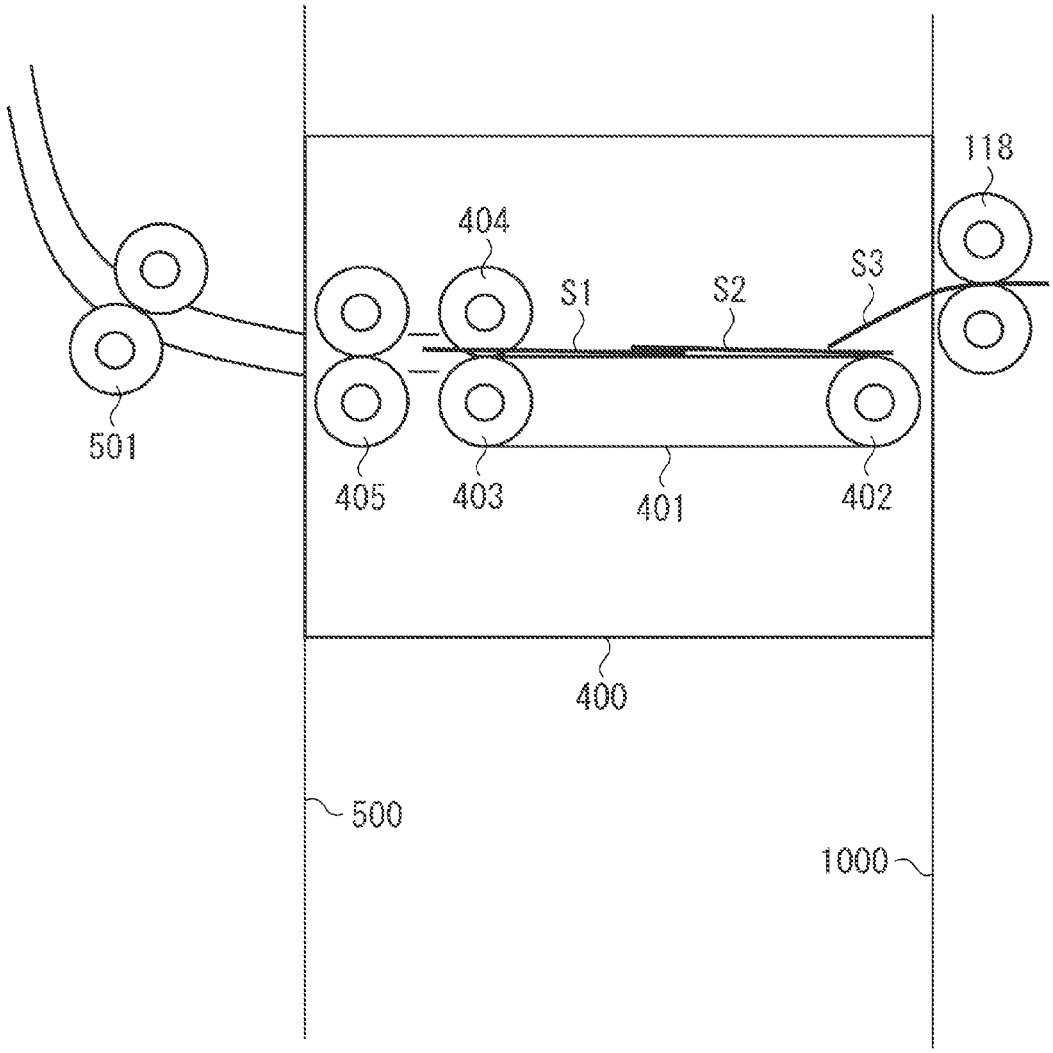
FIG. 3 is an enlarged view of the above-mentioned sheet overlapping portion.

As illustrated in FIG. 3, the sheet overlapping unit 400 is equipped with a conveyance belt 401 configured to receive a sheet having passed the discharge roller pair 118 of the printer 1000, and a conveyance roller pair 405 arranged downstream of the conveyance belt 401. The conveyance belt 401 is wrapped around a driven roller 402 and a driving roller 403, and is configured to be rotated through the rotation of the driving roller 403. After passing the conveyance roller pair 118, sheets S1 through S3 are successively delivered to the conveyance belt 401. Then, the delivered sheets are conveyed to a conveyance roller pair 405 by a conveyance roller 404 which is arranged above the conveyance belt 401 and the driving roller 403. The driving roller 403 and the conveyance roller pair 405 receive power input from a motor (not illustrated), i.e., the same drive source, and convey the sheets S1 through S3.

As compared with a conveyance speed at which the sheets S1 through S3 are conveyed by the discharge roller pair 118, a conveyance speed of the sheet overlapping unit 400 is set to be lower. In addition, the discharge roller pair 118 is situated above the conveyance belt 401. Thus, when the following sheet S2 is discharged after the first sheet S1 has been discharged onto the conveyance belt 401, the front end portion of the following sheet S2 overlaps the rear end portion of the first sheet S1, and, further, the front end portion of the following sheet S3 overlaps the rear end portion of the following sheet S2.

In this way, when one sheet bundle is discharged, the sheets S1 through S3 successively discharged from the printer 1000 are conveyed in an imbricate state to the sheet processing apparatus 500 by the sheet overlapping unit 400. Then, the conveyance roller pair 501 of the sheet processing apparatus 500 conveys the imbricate sheets S1 through S3 received from the sheet overlapping unit 400 to the shift unit 600.

Figure 4:
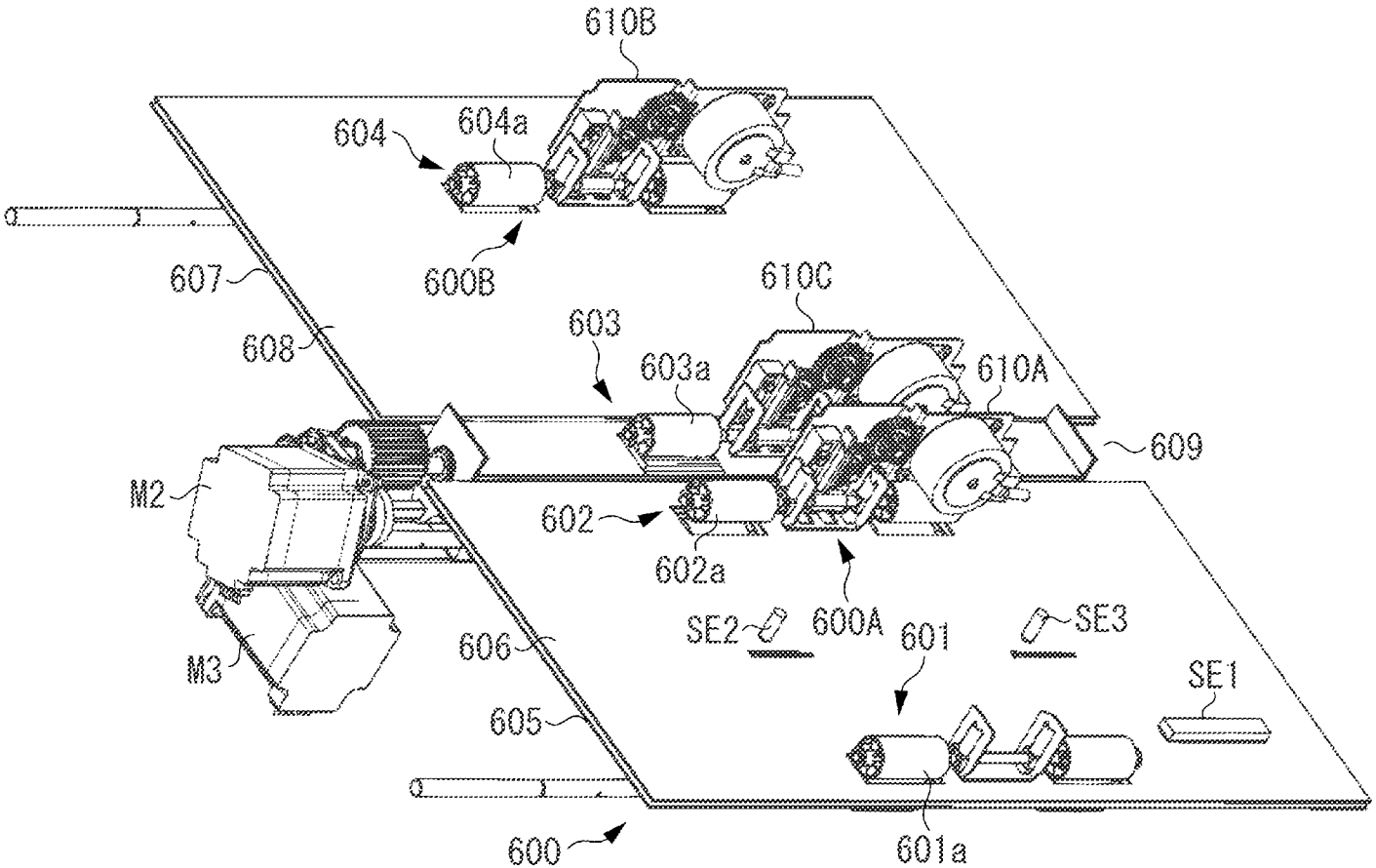
FIG. 4 is a first diagram illustrating a configuration of a shift unit provided in the above-mentioned sheet processing apparatus.

FIG. 4 illustrates the configuration of the shift unit 600 serving as a sheet conveyance apparatus. The shift unit 600 is equipped with conveyance roller pairs 601 through 604, and an image sensor SE1. The sensor SE1 is a side end detection unit configured to detect a side end position of the sheets conveyed in the widthwise direction orthogonal to the sheet conveyance direction. The shift unit 600 is also equipped with first and second sensors SE2 and SE3, which are detection units configured to detect an overlapping portion of imbricate sheets.

In addition, the shift unit 600 is equipped with conveyance guides 605 through 608 and a shift portion 609. The conveyance guides 605 through 608 form a sheet conveyance path through which the sheets pass. The shift portion 609 is configured to reciprocate in the widthwise direction to shift the sheets through normal and reverse rotation of a shift motor M3. According to the present exemplary embodiment, the shift portion 609 configured to shift the imbricate sheets in the widthwise direction is formed by a conveyance roller pair 603 capable of abutting on and separating from each other, and a separating mechanism 610C configured to attach to and separate from the conveyance roller pair 603 each other. A movement amount of the shift portion 609 is increased as a deviation in the widthwise direction of the side end portion of the sheet becomes larger based on the detection result of the image sensor SE1.

According to the present exemplary embodiment, upper rollers 602*a* through 604*a* constituting the conveyance roller pairs 602 through 604 capable of abutting on and separating from each other can be switched between contact and separation by separating mechanisms 610A through 610C described below. Further, the conveyance roller pairs 601, 602, and 604 rotate upon receiving drive from a motor (not illustrated), and the conveyance roller pair 603 of the shift portion 609 rotates upon receiving drive from a drive motor M2.

According to the present exemplary embodiment, the first conveyance roller pair 602 and the first separating mechanism 610A form a first sheet conveyance unit 600A configured to covey sheets having an overlapping portion where the rear end portion of a preceding sheet and the front end portion of a following sheet overlap each other. Further, the second conveyance roller pair 604 and the second separating mechanism 610B form a second sheet conveyance unit 600B configured to convey sheets having an overlapping portion. On the downstream in the sheet conveyance direction of the first sheet conveyance unit 600A, and on the upstream in the sheet conveyance direction of the second sheet conveyance unit 600B, there is arranged the shift portion 609 which is a movement portion movable in the widthwise direction while conveying sheets toward the second sheet conveyance unit 600A.

Figure 5:
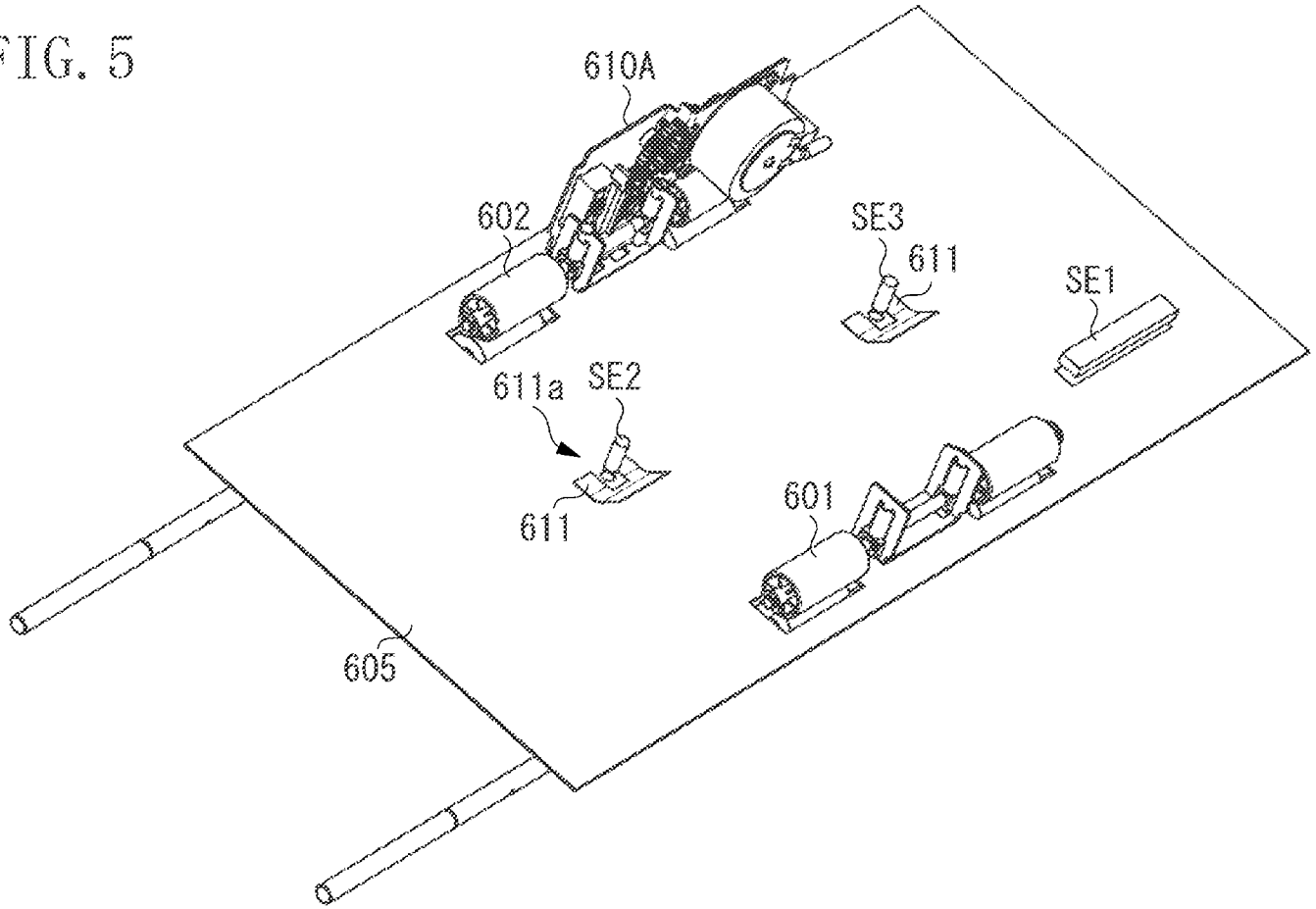
FIG. 5 illustrates a configuration of a first sheet conveyance portion of the above-mentioned shift unit.

FIG. 5 illustrates the configuration of the first sheet conveyance unit 600A of the shift unit 600. In FIG. 5, an upper guide 606 is removed for the sake of convenience in illustration. In FIG. 5, a pressing sheet 611 is mounted to the upper guide 606. The pressing sheet 611 presses the conveyed sheets against a lower guide 606.

The first and second sensors SE2 and SE3 are arranged side by side in the widthwise direction upstream in the sheet conveyance direction of the shift portion 609. By thus arranging the first and second sensors SE2 and SE3, it is possible to reliably detect overlap of sheets even when sheets are conveyed askew. According to the present exemplary embodiment, the sheet shifting operation described below is conducted by using as a reference that side selected from between the front side and the rear side where the overlapping amount is less. According to the present exemplary embodiment, the front side refers to the portion just in front of the user standing before the printer 1000 illustrated in FIG. 1, and the rear side refers to the portion away from the user in the depth direction.

Figure 6A:
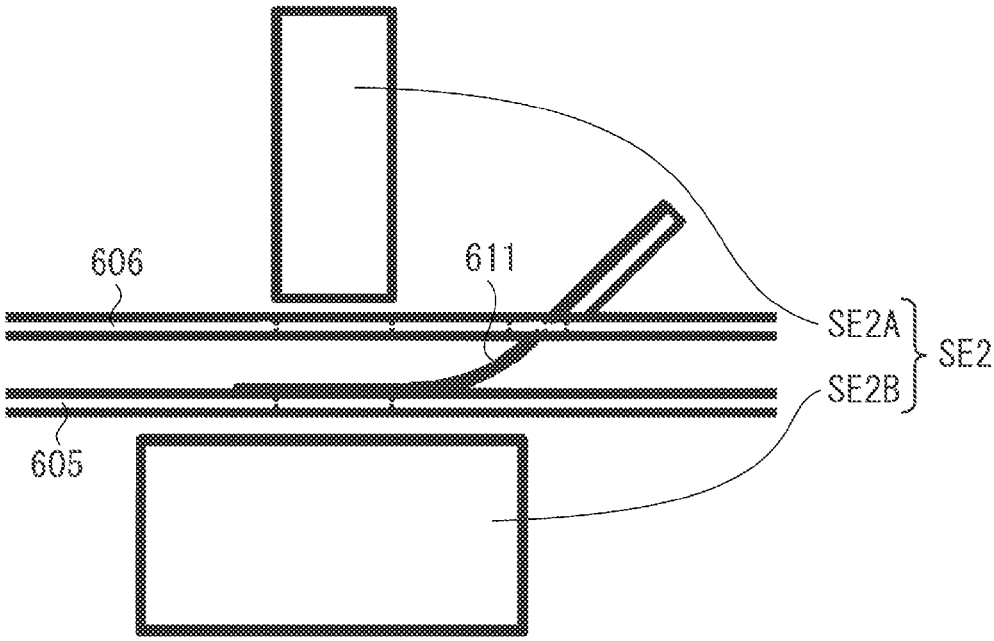
FIGS. 6A and 6B illustrate a configuration of first and second sensors provided in the above-mentioned shift unit.
Figure 6B:
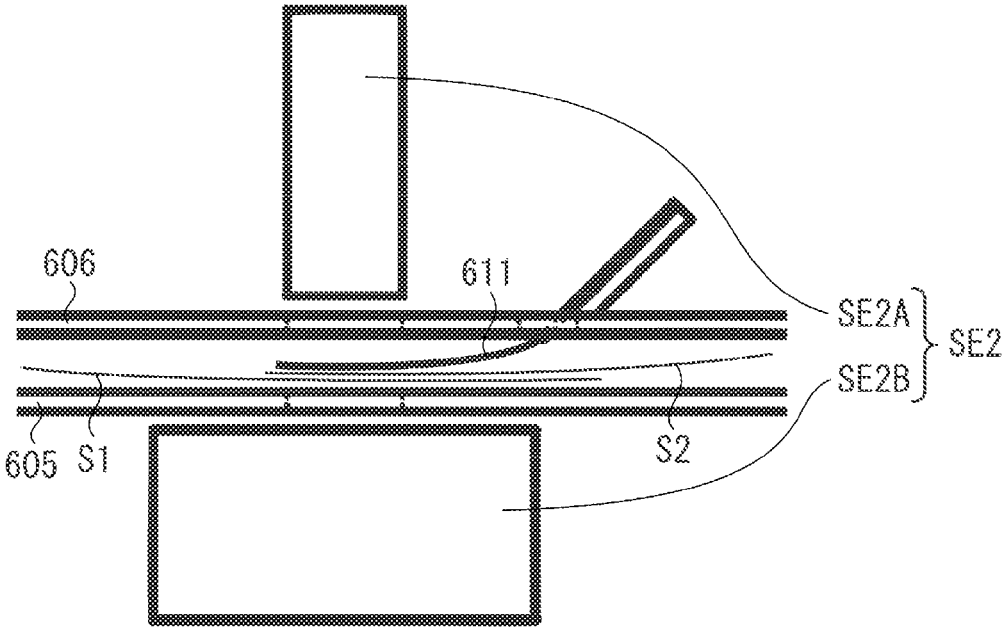

The first and second sensors SE2 and SE3 are arranged at positions corresponding to a notch portion 611*a* formed at the center of the pressing sheet 611. Further, as illustrated in FIGS. 6A and 6B, for example, the first sensor SE2 is equipped with a light emitting portion SE2A and a light receiving portion SE2B, and detects overlap of sheets from an increase or decrease in a quantity of light reaching the light receiving portion SE2B. FIG. 6A illustrates a state in which no sheet is passing between the light emitting portion SE2A and the light receiving portion SE2B, and FIG. 6B illustrates how two sheets S1 and S2 overlapping each other pass between the light emitting portion SE2A and the light receiving portion SE2B.

In the case in FIG. 6B, the light emitted from the light emitting portion SE2A is reduced in quantity before reaching the light receiving portion SE2B. When the overlapping portion of the sheets S1 and S2 passes the sensor SE2, the quantity of light reduced is larger than when a single sheet passes the same, so that it is possible to detect the start of the overlapping portion. In addition, the pressing sheet 611 applies a force to the sheets S1 and S2 toward a lower guide 605, so that no air layer is generated at the overlapping portion of the sheets S1 and S2. Thus, it is possible to reliably detect a boundary where the quantity of light increases or decreases. The sensor SE3 functions in the similar manner.

Figure 7A:
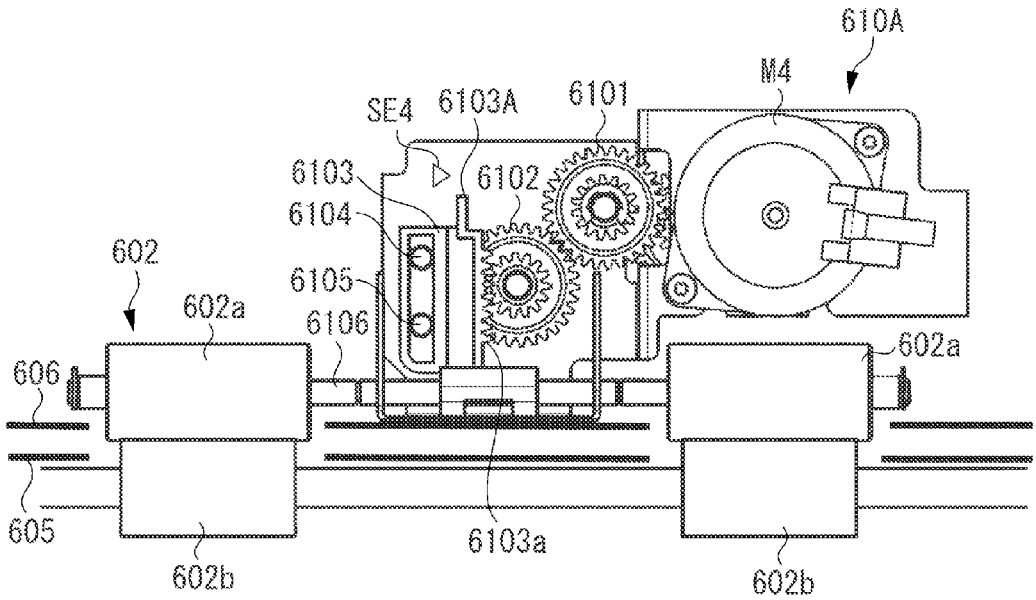
FIGS. 7A and 7B illustrate a configuration of a separating mechanism of a conveyance roller pair provided in the above-mentioned shift unit.
Figure 7B:
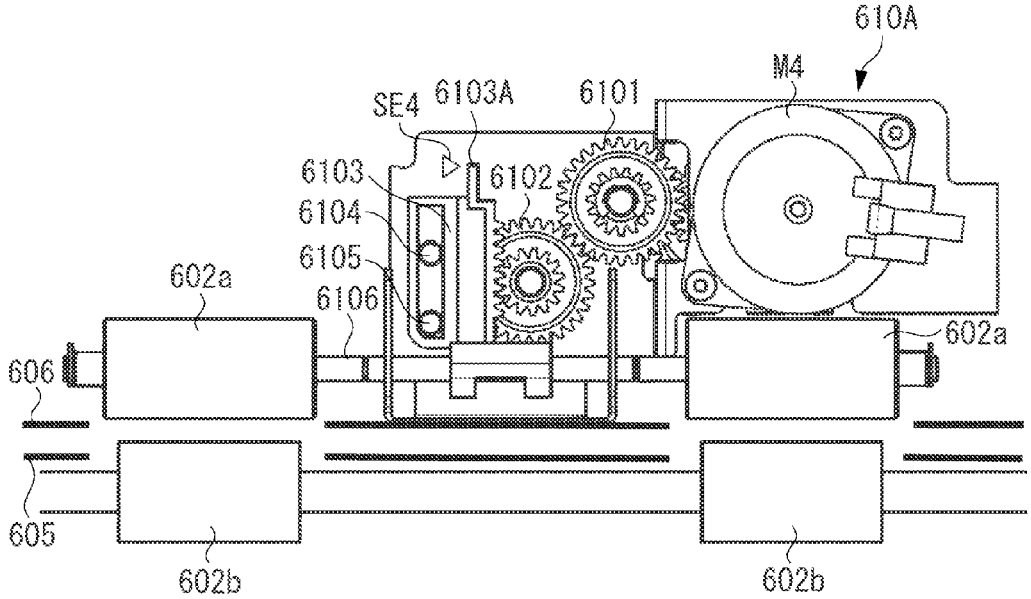

FIGS. 7A and 7B illustrate the configuration of the separating mechanism 610A of the first conveyance roller pair 602. The separation mechanisms 610B and 610C of the conveyance roller pair 603 and the second conveyance roller pair 604 are of the same configuration. The separating mechanism 610A is equipped with an elevation motor M4, gears 6101 and 6102 configured to be rotated by the elevation motor M4, a holder 6103 for holding a roller shaft 6106, and two shafts 6104 and 6105 arranged in the vertical direction so as to guide the elevation of the holder 6103. The holder 6103 is equipped with a rack gear 6103*a* which meshes with the gear 6102 and extends in the vertical direction, and an upper roller 602*a* of the conveyance roller pair 602 is rotatably mounted to the roller shaft 6106.

In the separating mechanism 610A, configured as described above, when the elevation motor M4 rotates, the rotational drive of the elevation motor M4 is transmitted to the holder 6103 via the gears 6101 and 6102 and the rack gear 6103. Accordingly, the holder 6103 moves in the vertical direction along the shafts 6104 and 6105 to vertically move the roller shaft 6106. Through this operation, the upper roller 602*a* of the first conveyance roller pair 602 moves to a position where it is in contact with a lower side roller 602*b* illustrated in FIG. 7A and to a position where it is separated from the lower roller 602*b* illustrated in FIG. 7B.

The shift unit 600 is provided with a position sensor SE4 configured to detect the position of the holder 6103. When the position sensor SE4 detects a protrusion 6103A of the holder 6103 at the time of ascent of the holder 6103, a control unit described below determines that the first conveyance roller pair 602 is placed in a separation state, and stops the rotation of the elevation motor M4. When the first conveyance roller pair 602 is placed in a contact state, a sheet processing apparatus control unit 500A described below causes the elevation motor M4 to rotate by a predetermined amount when the position sensor SE4 has ceased to detect the protrusion 6103A.

Figure 8:
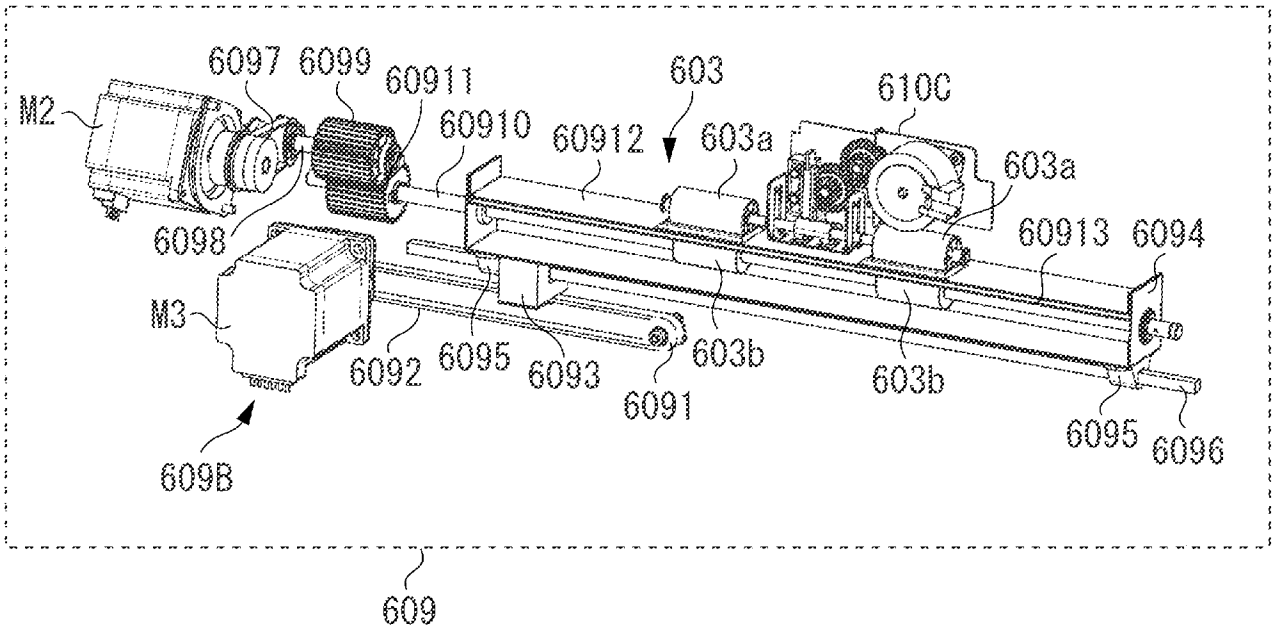
FIG. 8 illustrates a configuration of a shift portion provided in the above-mentioned shift unit.

FIG. 8 is a perspective view of the shift portion 609. In addition to the above-described shift motor M3, the shift portion 609 is provided with a belt 6092 wrapped around a pulley 6091 and the shift motor M3, a slide member 6093 mounted to the belt 6092, and a frame 6094 mounted to the slide member 6093. When the shift motor M3 rotates, the belt 6092 rotates, and the frame 6094 slides in the widthwise direction integrally with the slide member 6093.

Mounted on the frame 6094 is a slider 6095 configured to slide along a rectangular shaft 6096 extending in the widthwise direction and to guide the movement of the slide member 6093. In addition, guides 60912 and 60913 forming a guide path for guiding the conveyance of the sheet are mounted to the frame 6094. According to the present exemplary embodiment, a movement mechanism 609B configured to reciprocate the shift portion 609 in the widthwise direction is formed by the shift motor M3, the belt 6092, the slide member 6093, and the like.

The shift portion 609 is provided with the drive motor M2 described above, a belt 6097 configured to transmit the rotation of the drive motor M2 to a shaft 6098, a gear 6099 mounted to the shaft 6098, and a gear 60911 mounted to a conveyance roller shaft 60910. A drive roller 603*b* of the conveyance roller pair 603 is mounted to the conveyance roller shaft 60910. When the drive motor M2 rotates, the rotational drive of the drive motor M2 is transmitted to the conveyance roller shaft 60910 via the belt 6097 and the gears 6099 and 60911, and the drive roller 603*b* rotates together with the conveyance roller shaft 60910.

Figure 9A:
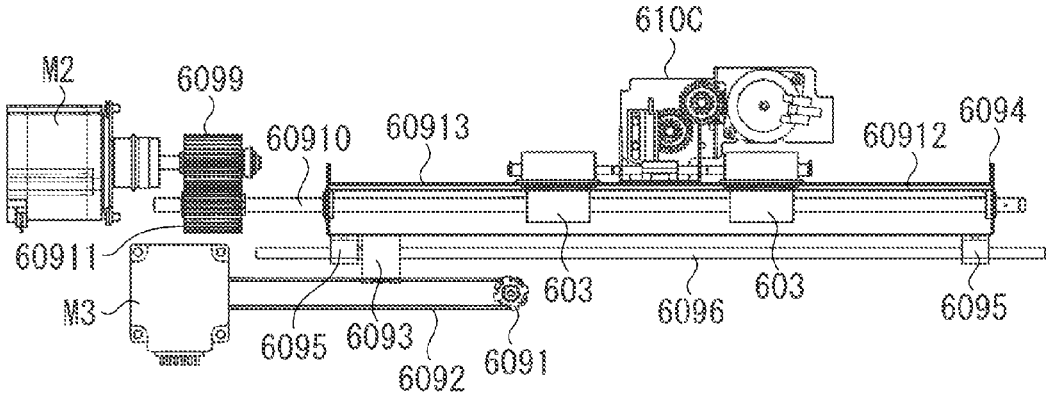
FIGS. 9A through 9C illustrate a shift operation of the above-mentioned shift portion.
Figure 9B:
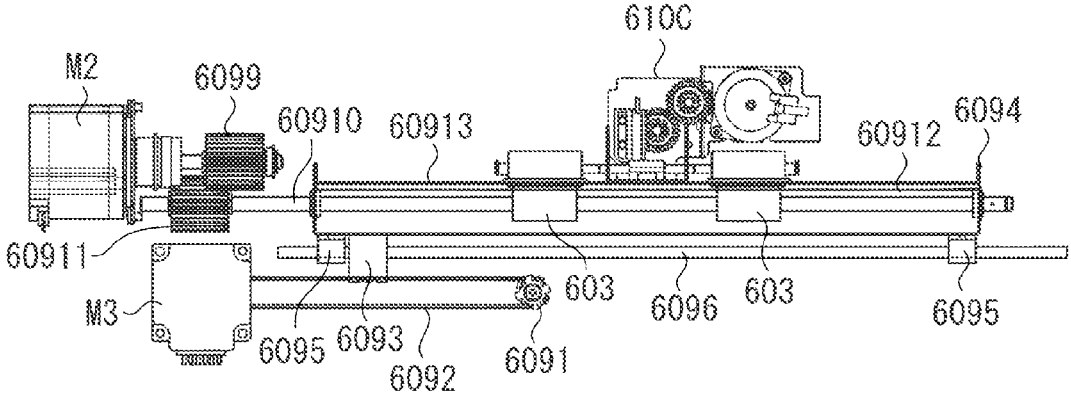
Figure 9C:
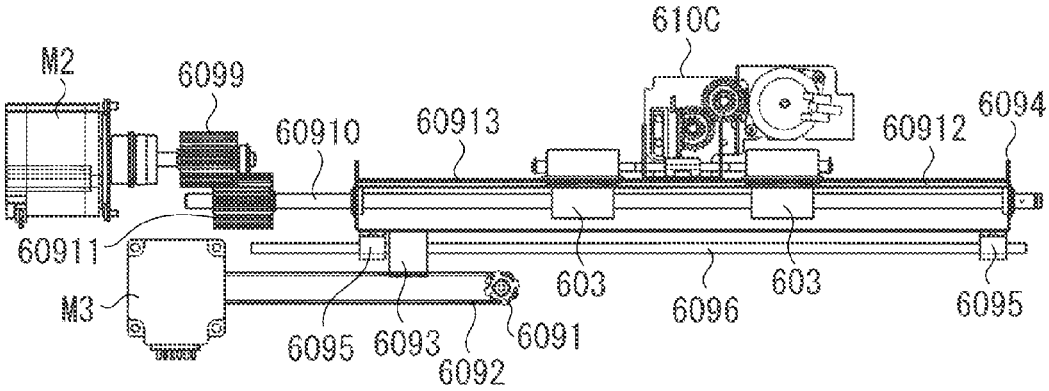

FIGS. 9A through 9C illustrate the shifting operation of the shift portion 609. Until a sheet is conveyed, the frame 6094 of the shift portion 609 is placed at an initial position illustrated in FIG. 9A. When the conveyed sheet is shifted, for example, to the front side, the frame 6094 is moved to the front side as illustrated in FIG. 9B through the driving of the shift motor M3 while conveying the sheet by the conveyance roller pair 603. To perform the shifting operation while conveying a sheet, the rotational drive of the drive motor M2 is transmitted to the conveyance roller pair 603 via the gears 6099 and 60911.

When the conveyed sheet is shifted to the rear side, the frame 6094 is moved to the rear side through the reverse driving of the shift motor M3 as illustrated in FIG. 9C. In order that the rotational drive of the drive motor M2 may be transmitted to the conveyance roller pair 603 even in the case the frame 6094 is thus moved, the gears 6099 and 60911 are formed in large width.

Figure 10:
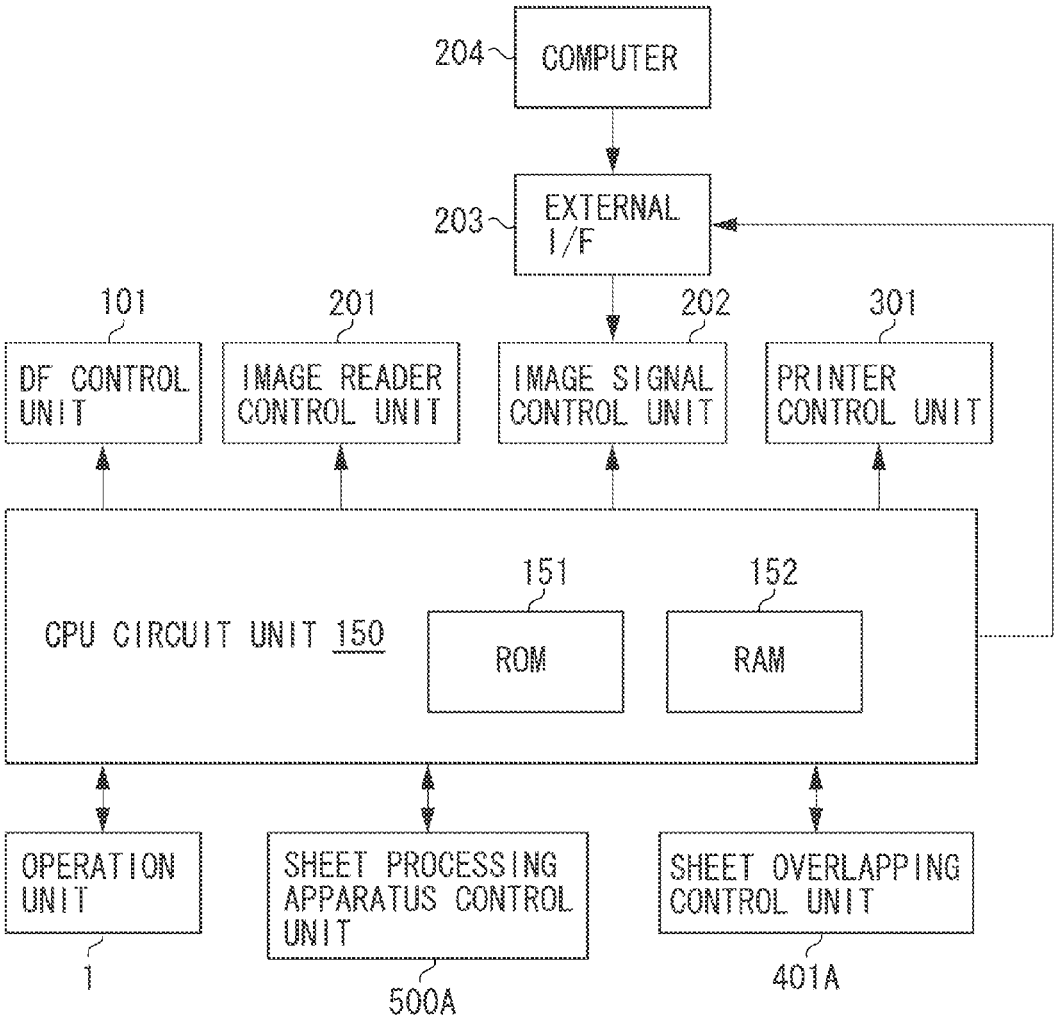
FIG. 10 is a control block diagram of a printer constituting an example of the above-mentioned image forming apparatus.
Figure 11:
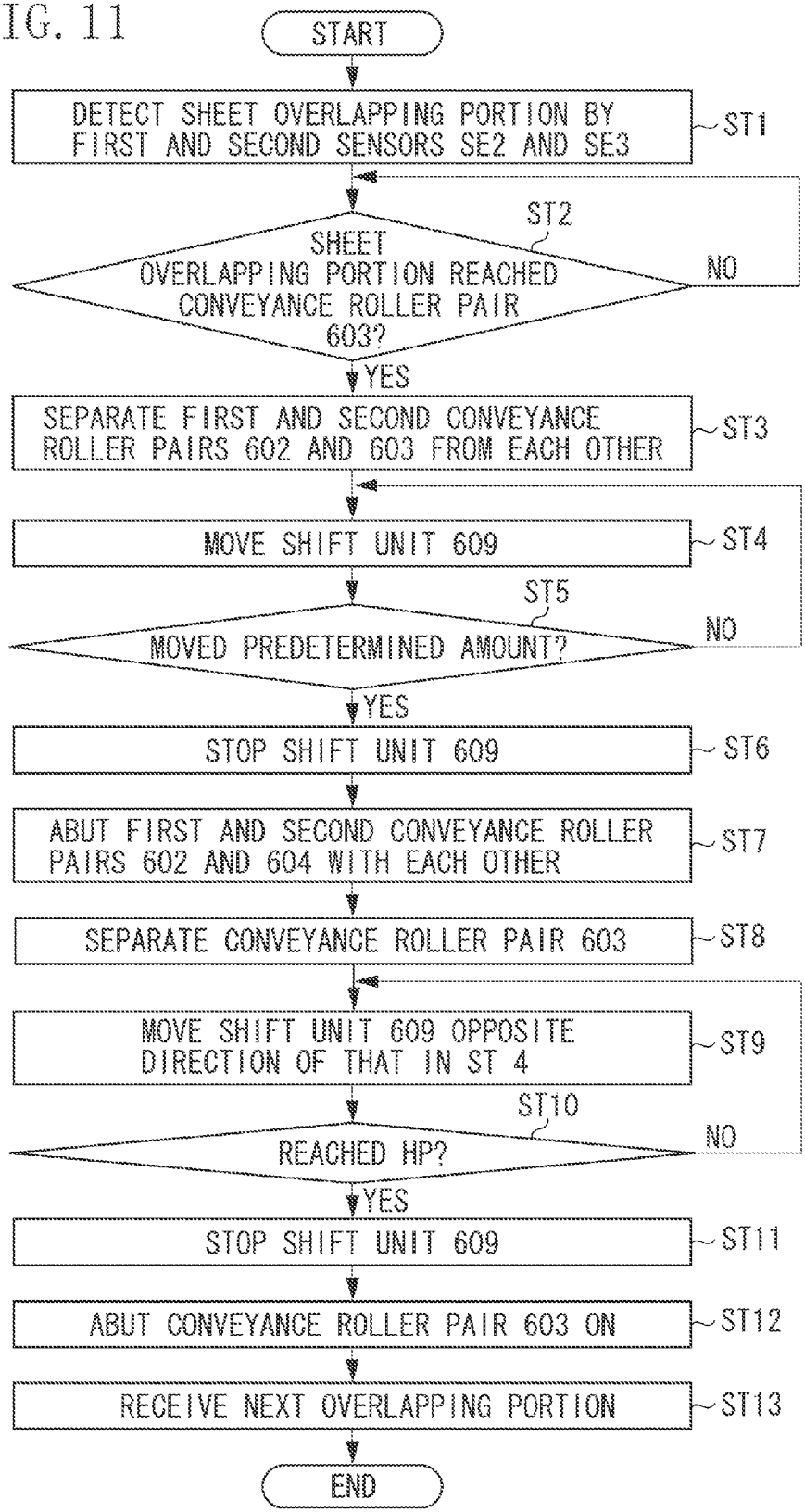
FIG. 11 is a flowchart related to a sheet processing operation of the above-mentioned sheet processing apparatus.

FIG. 10 is a control block diagram of the printer 1000. A central processing unit (CPU) circuit unit 150 is arranged at a predetermined position in the printer main body 300, and includes a CPU (not illustrated). In accordance with a control program stored in a read-only memory (ROM) 151 and a setting of an operation unit 1, the CPU circuit unit 150 controls the following units. More specifically, the CPU circuit unit 150 controls a document feeder (DF) control unit (document feeding control unit) 101, an image reader control unit 201, an image signal control unit 202, a printer control unit 301, a sheet overlapping unit control unit 401A, a sheet processing apparatus control unit 500A, and an external interface (I/F) 203.

The DF control unit 101 controls the document feeding unit 100, and the image reader control unit 201 controls the scanner 200 forming an image reader portion. The printer control unit 301 controls the printer main body 300. The sheet overlapping unit control unit 401A controls the sheet overlapping unit 400. The sheet processing apparatus control unit 500A controls the driving of the conveyance roller pairs 501 through 505 in the sheet processing apparatus 500, the discharge roller 506, and the shift portion 609.

The operation unit 1 includes a plurality of keys for setting various functions related to image formation, a display portion for displaying the setting condition, and the like. The operation unit 1 outputs a key signal corresponding to an operation of each key by a user to the CPU circuit unit 150, and displays corresponding information on the display portion based on the signals from the CPU circuit unit 150.

A random-access memory (RAM) 152 is used as an area for temporarily retaining control data, and as a work area for calculation accompanying the control. The external I/F 203 is an interface between the printer 1000 and an external computer 204. The external I/F 203 develops print data from the computer 204 on a bit map image, and outputs it to the image signal control unit 202 as image data. An image of a document read by the image sensor 109 is output from the image reader control unit 201 to the image signal control unit 202. The printer control unit 301 outputs the image data received from the image signal control unit 202 to the exposure control unit 110. Although in the present exemplary embodiment, the control of the sheet processing apparatus 500 is performed by the sheet processing apparatus control unit 500A serving as a control unit, it is also possible for the CPU circuit control unit 150 to control the sheet processing apparatus 500.

According to the present exemplary embodiment, when one sheet bundle is discharged, sheets imbricated by the sheet overlapping unit 400 are discharged, and then a next sheet bundle is shifted in a direction opposite to that of the first sheet bundle and stacked on the tray 700. Accordingly, a boundary between the sheet bundles can be clearly distinguished.

Next, the sheet processing operation performed by the sheet processing apparatus 500 according to the present exemplary embodiment will be described with reference to a flowchart in FIG. 11 and FIGS. 12A through 12E.

First, a position in the widthwise direction of the first sheet bundle of sheets imbricated by the sheet overlapping unit 400 is detected by the image sensor SE1 provided upstream in the sheet conveyance direction of the shift portion 609. Then, the sheets pass the first and second image sensors SE2 and SE3. At this time, in step ST1, an overlapping portion (overlapping amount) of the imbricate sheets is detected by the first and second image sensors SE2 and SE3.

In some cases, the preceding sheet, for example, is conveyed askew. When a sheet is thus skew, the overlapping amount (overlapping width) of the preceding sheet and the following sheet in the widthwise direction differs. Further, in the case where the sheets in this state are shifted by the conveyance roller pair 603 as described below, if the sheets are shifted using the side where the overlapping amount is larger as the reference, there is a possibility that the conveyance roller pair 603 cannot retain the sheet overlapping portion on the side where the overlapping amount is small. In view of this, as described above, according to the present exemplary embodiment, two sensors of the first and second sensors SE2 and SE3 are arranged in the widthwise direction, and based on the signals from the two sensors SE2 and SE3, the sheet processing apparatus control unit 500A performs the processing based on the detection on the side where the overlapping amount is smaller.

Figure 12A:
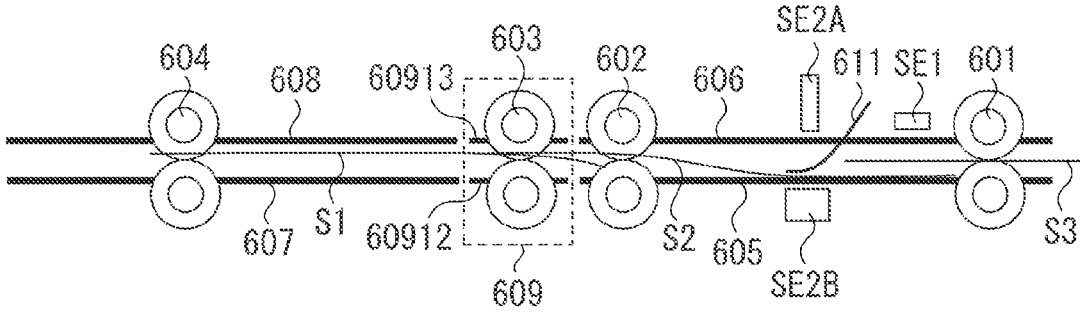
FIGS. 12A through 12E are first diagrams illustrating a sheet shifting operation of the above-mentioned shift unit.
Figure 12B:
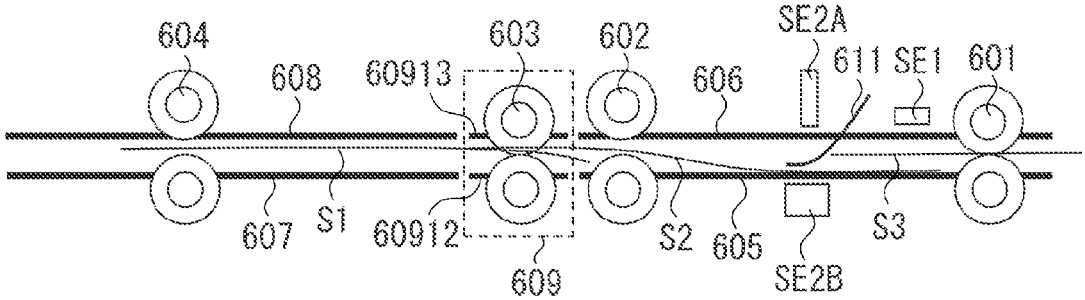

After the sheet overlapping portion is detected by the first and second sensors SE2 and SE3, the imbricate sheets S1 and S2 are conveyed by a predetermined amount by the conveyance roller pairs 601 and 602. Then, as illustrated in FIG. 12A, the overlapping portion of the sheets S1 and S2 reaches the conveyance roller pair 603. In step ST2, when the overlapping portion reaches the conveyance roller pair 603 (YES in step ST2), the processing proceeds to step ST3. In step ST3, the sheet processing apparatus control unit 500A operates the separating mechanisms 610A and 610B to place the first and second conveyance roller pairs 602 and 604 in the separation state as illustrated in FIG. 12B.

Next, in step ST4, the sheet processing apparatus control unit 500A rotates the shift motor M3. Accordingly, the shift portion 609 is moved (shifted) in the depth direction, so that the sheets S1 and S2 are shifted. The shift amount at this time is determined using the sheet position detected by the image sensor SE1 as the reference. In step ST5, if the sheets is moved by a predetermined amount (YES in step ST5), then in step ST6, the shift motor M3 is stopped to stop the shift portion 609. When the sheet shifting operation by the shift portion 609 is completed, then in step ST7, the sheet processing apparatus control unit 500A operates the separating mechanisms 610A and 610B to place the first and second conveyance roller pairs 602 and 604 in the contact state.

Figure 12C:
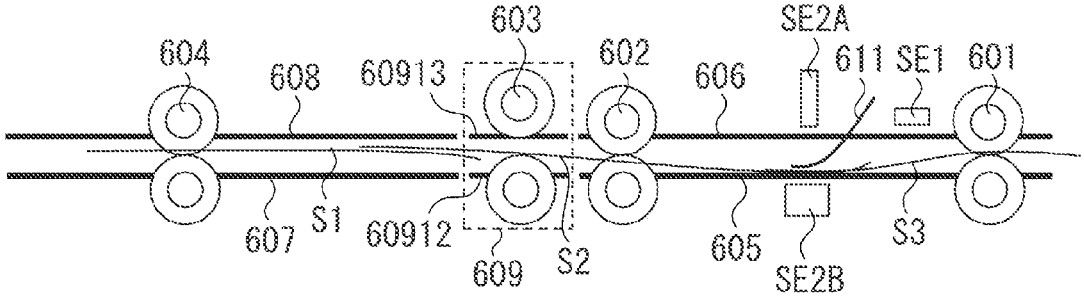
Figure 12D:
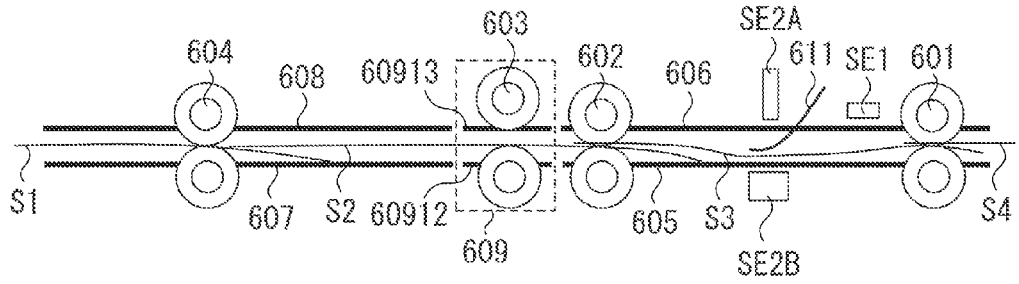

Next, when the contacting of the first and second conveyance roller pairs 602 and 604 is completed, then in step ST8, the separating mechanism 610C of the conveyance roller pair 603 is operated to place the conveyance roller pair 603 in the separated state as illustrated in FIG. 12C. Then, the sheets S1 and S2 are conveyed by the first and second conveyance roller pairs 602 and 604 in the contact state as illustrated in FIG. 12D.

Figure 12E:
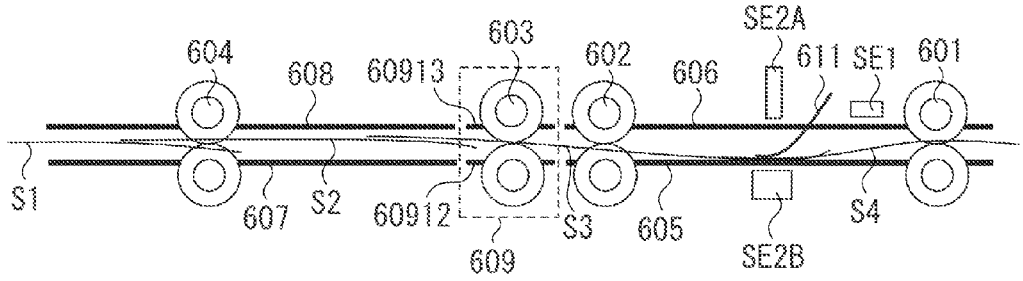

When the separation of the conveyance roller pair 603 is completed, in step ST9, the shift motor M3 is reversed to move the shift portion 609 in a direction opposite to the direction in which it has been moved in step ST4. In step ST10, when the shift portion 609 reaches at an initial position HP which is the position prior to the movement (YES in step ST10), then in step ST11, the shift motor M3 is stopped to stop the shift portion 609. Next, when the movement of the shift portion 609 is completed, in step ST12, the sheet processing apparatus control unit 500A operates the separating mechanism 610C to place the conveyance roller pair 603 in the contact state again. Then in step ST13, there is attained a state in which the overlapping portion of the following sheets S3 and S4 is received as illustrated in FIG. 12E.

Figure 13A:
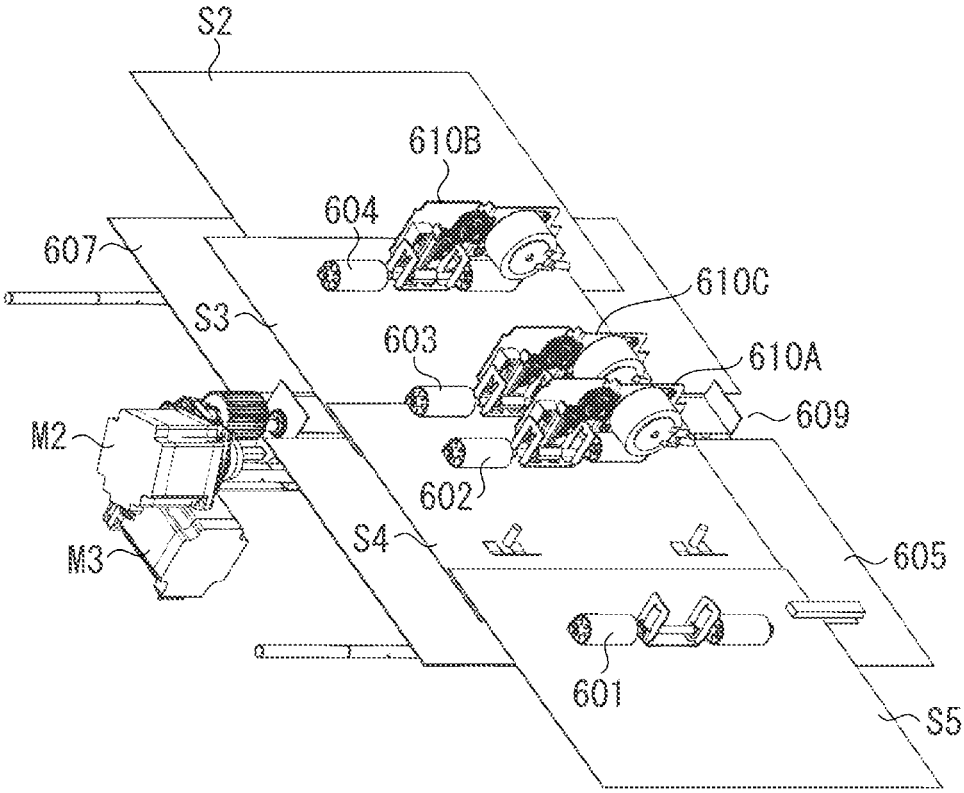
FIGS. 13A and 13B are second diagrams illustrating the sheet shifting operation of the above-mentioned shift unit.
Figure 13B:
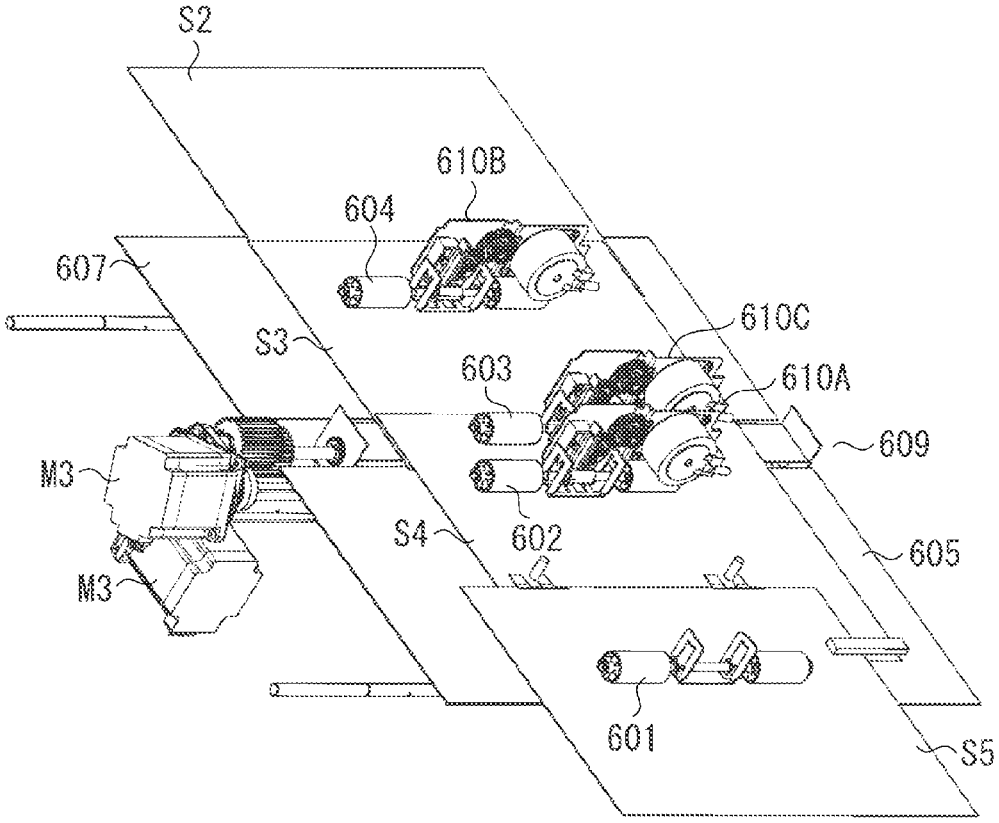

FIG. 13A illustrates the state in which the overlapping portion of the following sheets S3 and S4 is received. After the reception of the succeeding two sheets S3 and S4, when the overlapping portion of the sheets S3 and S4 reaches the shift portion 609, the first and second conveyance roller pairs 602 and 604 are separated. Next, as illustrated in FIG. 13B, the shift portion 609 is moved in the same direction as the foregoing sheets S1 and S2, and the sheets S3 and S4 are shifted to the same position as that of the sheet S2. By repeatedly performing this operation, the sheets forming the first sheet bundle are shifted and stacked on the tray 700. When the shifting of a predetermined number of sheets of the first sheet bundle is completed, the sheets forming the next sheet bundle are shifted in a direction opposite to that of the foregoing sheet bundle and are stacked on the tray 700.

FIG. 14 illustrates how sheet bundles are stacked on the tray 700 in succession while changing the shifting direction, that is, the moving direction of the shift portion 609, for each sheet bundle. In a state in which it is shifted by a predetermined amount with respect to a first sheet bundle T1 stacked first, the next sheet bundle T2 is stacked. The next sheet bundle T3 is stacked on the tray 700 while shifted to the same position as that of the sheet bundle T1. Similarly, the sheet bundle T4 is shifted to the same position as that of the sheet bundle T2. Accordingly, the boundary between the sheet bundles is clarified.

In this way, according to the present exemplary embodiment, when it is determined that a sheet overlapping portion has reached the conveyance roller pair 603 of the shift portion 609, the shift portion 609 is moved in the widthwise direction while changing the moving direction in the widthwise direction for each sheet bundle. Accordingly, even in the case of sheets partially overlapping each other, the sheets can be reliably shifted in the widthwise direction and discharged. Further, by moving the overlapping portions of imbricate sheets as in the present exemplary embodiment, it is possible to simultaneously shift two sheets, so that productivity can be improved.

Figure 15:
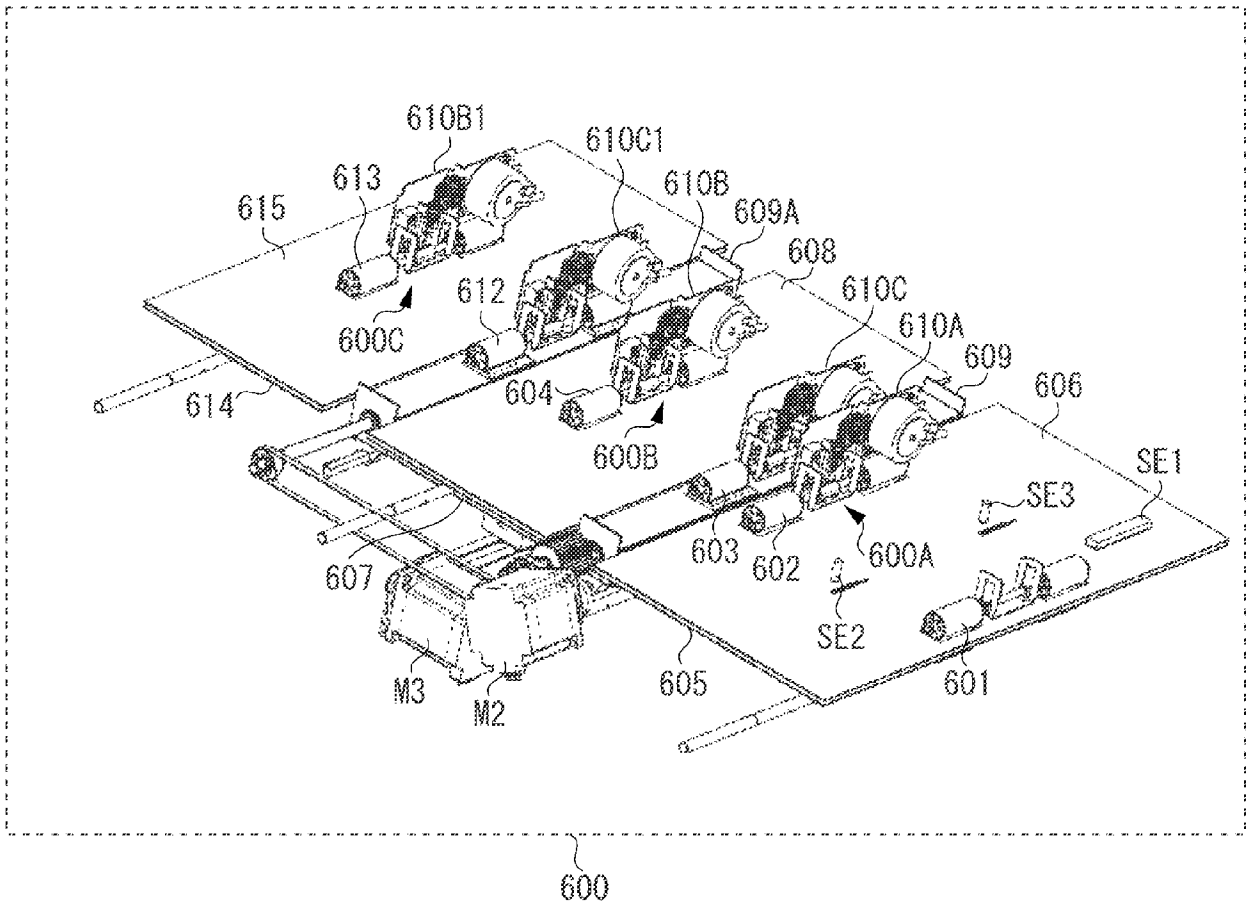
FIG. 15 illustrates a configuration of a shift unit provided in a sheet processing apparatus according to a second exemplary embodiment.

Next, a second exemplary embodiment will be described. FIG. 15 illustrates a configuration of a shift unit provided in a sheet processing apparatus according to the present exemplary embodiment. In FIG. 15, the same reference numerals as those in FIG. 4 indicate the same or equivalent components. The shift unit according to the present exemplary embodiment can shift sheets in the case where a sheet bundle is formed by an odd number of sheets.

In FIG. 15, a shift portion 609A is provided downstream in the sheet conveyance direction of the shift portion 609. More specifically, according to the present exemplary embodiment, sheets are shifted by the upstream shift portion 609 and the downstream shift portion 609A. The shift portion 609A which is the downstream movement portion is equipped with a conveyance roller pair 612 which is a downstream conveyance roller pair and a downstream separating mechanism 610C1. In FIG. 15, guides 614 and 615 are provided downstream in the sheet conveyance direction of the shift portion 609A. The sheets passing the guides 614 and 615 are conveyed by a conveyance roller pair 613.

The conveyance roller pair 613 which is the third conveyance roller pair and the conveyance roller pair 612 of the shift portion 609A are switched between contact and separation by separating mechanisms 610B1 and 610C1. According to the present exemplary embodiment, a third sheet conveyance unit 600C provided downstream in the sheet conveyance direction of the shift portion 609A is formed by the conveyance roller pair 613 and the third separating mechanism 610B1.

Figure 16:
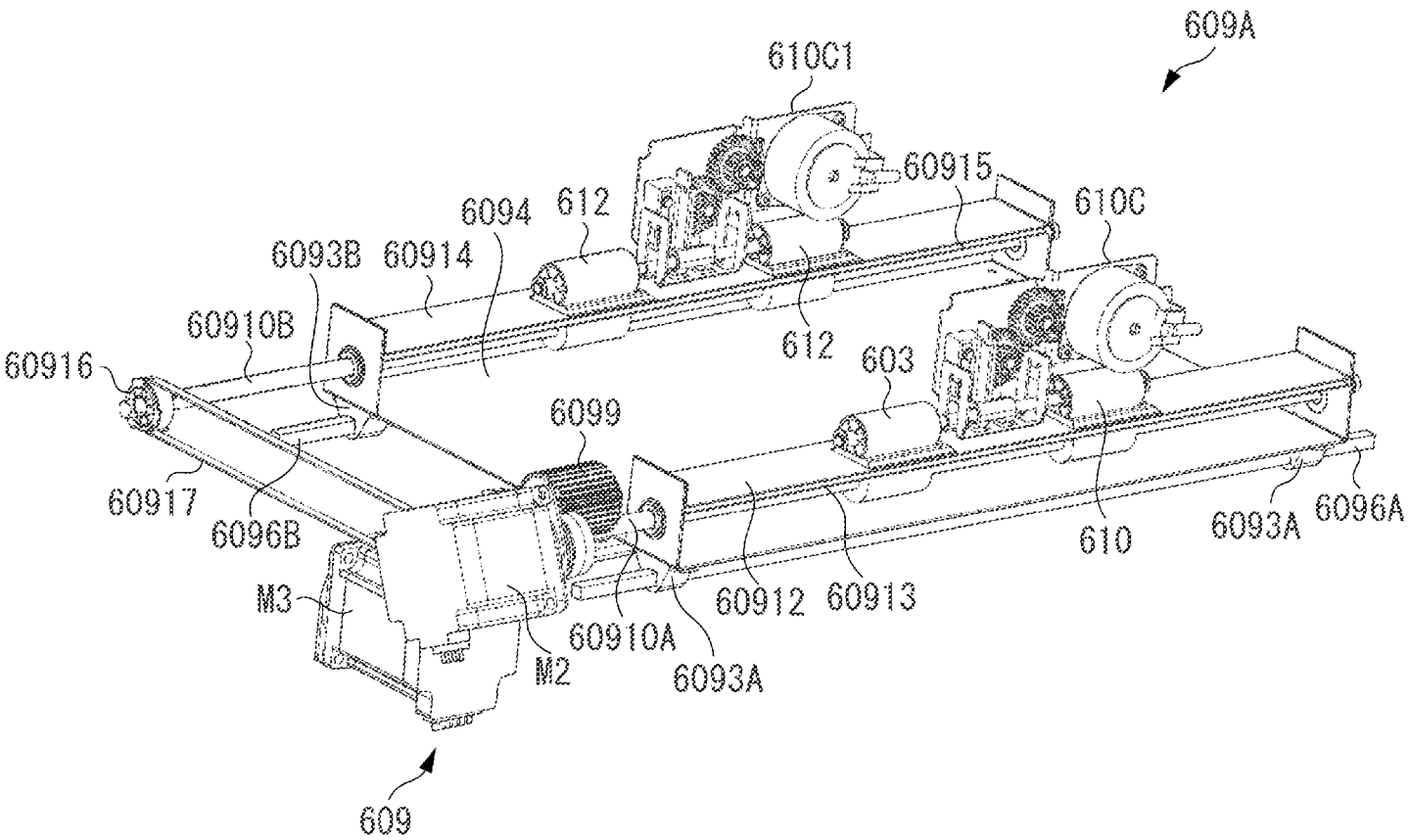
FIG. 16 illustrates a configuration of a shift portion provided in the above-mentioned shift unit.

As illustrated in FIG. 16, the conveyance roller pairs 603 and 612 of the two shift portions 609 and 609A are mounted to a frame 6094 of the shift unit 600. As in the above-described first exemplary embodiment, the conveyance roller pairs 603 and 612 integrally slide in the widthwise direction by the driving of the shift motor M3. More specifically, according to the present exemplary embodiment, the downstream movement mechanism configured to reciprocate the shift portion 609A in the widthwise direction is formed by the shift motor M3, the belt 6092 (see FIG. 8), the slide members 6093A and 6093B, and the like. The sliding movement of the shift portions 609 and 609A is realized through the movement of the slide members 6093A and 6093B mounted to the frame 6094 along rectangular shafts 6096A and 6096B each extending in the sliding direction.

The drive motor M2 for driving the conveyance roller pair 603 transmits rotational drive to the conveyance roller pair 612 via the gear 6099, the belt 60917, and the pulley 60916, so that the sheets passing between the guides 60912 through 60915 are conveyed. Although according to the present exemplary embodiment, the conveyance roller pairs 603 and 612 are driven by the drive motor M2, it is also possible to separately drive the conveyance roller pair 612 by another drive motor. Further, according to the present exemplary embodiment, the conveyance roller pairs 603 and 612 are attached to and separated from each other by the different separating mechanisms 610C and 610C1. Accordingly, when an overlapping portion between the sheets reaches the conveyance roller pairs 603 and 612, it is possible to move the shift portions 609 and 609A while holding the sheets by the conveyance roller pairs 603 and 612.

Figure 17A:
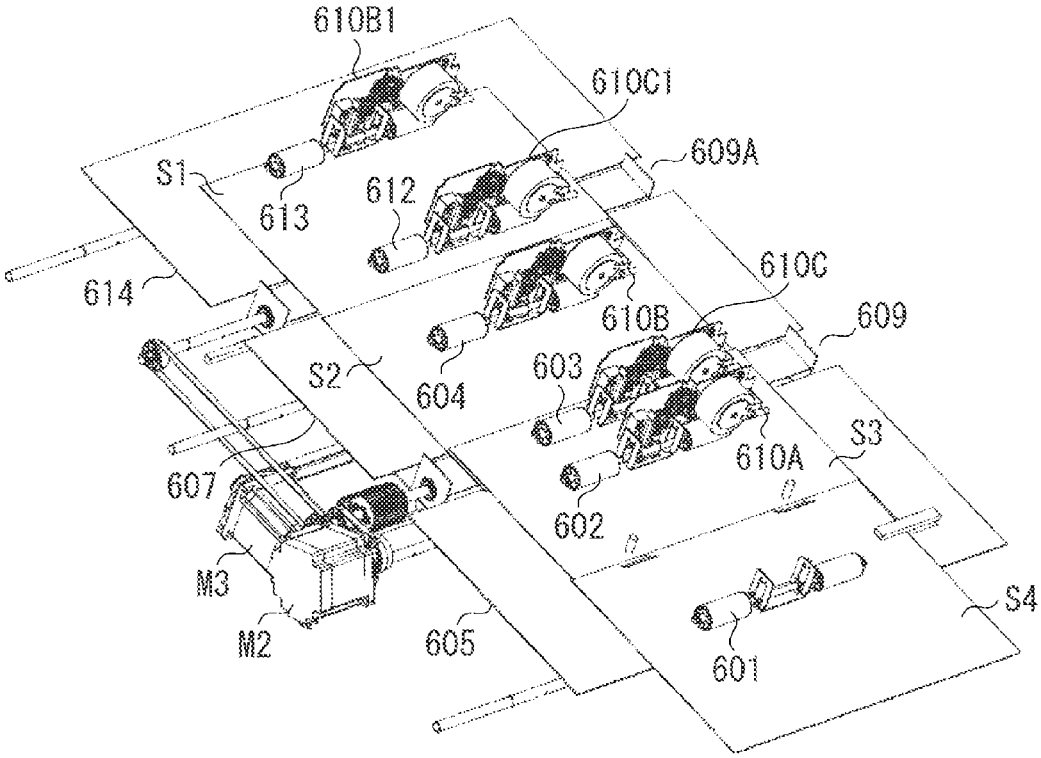
FIGS. 17A and 17B illustrate a sheet shifting operation of the above-mentioned shift unit.
Figure 17B:
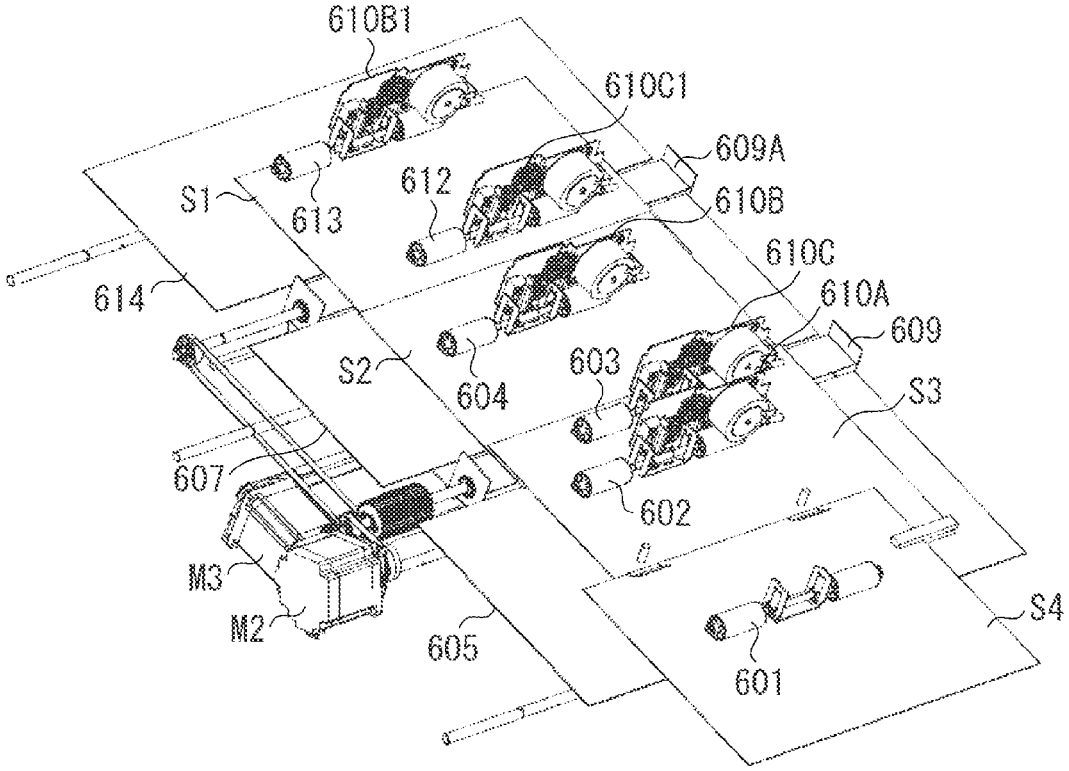

FIGS. 17A and 17B illustrate the sheet shifting operation of the shift unit 600 configured as described above. In FIGS. 17A and 17B, the method for detecting the position of the sheet in the widthwise direction and the overlapping amount is similar to that of the first exemplary embodiment described above, so that descriptions thereof will be omitted. Further, for the sake of convenience, in FIGS. 17A and 17B, the guides 606, 608, 615, 60912, and 60914 are omitted.

FIG. 17A illustrates a state in which the overlapping portion of the sheet S1 (preceding sheet) and the sheet S2 (following sheet), and the overlapping portion of the sheet S2 and the sheet S3 (next following sheet) have respectively reached the conveyance roller pairs 603 and 612. When the overlapping portions of the sheets S1, S2, and S3 thus respectively reach the conveyance roller pairs 603 and 612, the conveyance roller pairs 602, 604, and 613 are separated by the separating mechanisms 610C and 610C1. When the separation of the conveyance roller pairs 602, 604, and 613 is completed, the shift portions 609 and 609A move from the initial position toward the rear side while conveying the sheets by the conveyance roller pairs 603 and 612. Accordingly, the three sheets S1 through S3 move simultaneously as illustrated in FIG. 17B.

After the movement of the sheets S1 through S3 to the rear side, the conveyance roller pairs 602, 604, and 613 are placed in the contact state, the conveyance roller pairs 603 and 612 are placed in the separation state, and the shift portions 609 and 609A are moved to the front side to return to the initial position. When the shift portions 609 and 609A have returned to the initial position, the conveyance roller pair 603 is placed in the contact state, and the preparation for shifting the following sheet is completed.

According to the present exemplary embodiment, even when the conveyance roller pair 603 is placed in the contact state, the conveyance roller pair 612 remains in the separation state, and, from this onward, during a period for sheets for one sheet bundle are conveyed, the conveyance roller pair 612 is not placed in the contact state. Accordingly, at first, the shifting of the three sheets is performed, and then, it is possible to perform the operation of shifting the two sheets as in the first exemplary embodiment described above. Accordingly, even in the case of a sheet bundle including an odd number of sheets, it is possible to shift two or three sheets, and thus the high productivity can be obtained.

In the above-described case, the first three sheets of a sheet bundle including an odd number of sheets are shifted simultaneously, and then the shifting is performed two by two. The present exemplary embodiment, however, is not limited to this arrangement. For example, in the case of a sheet bundle including an odd number of sheets, the shifting may be performed at first two by two, and the last three sheets may be shifted simultaneously. Further, according to the number of sheets, the shifting may be performed three by three, and two sheets may be shifted at the first, last, or halfway through.

Figure 18:
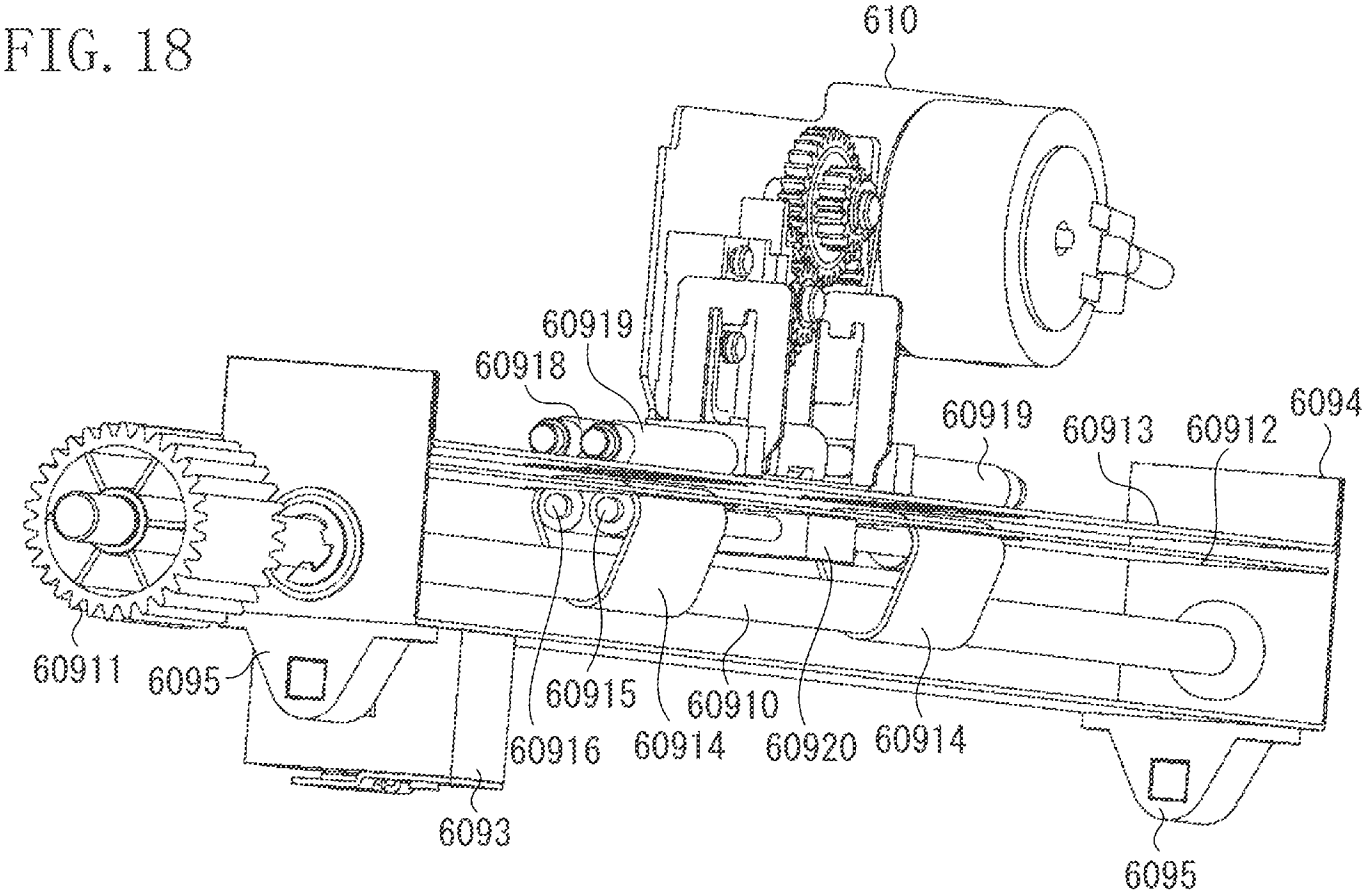
FIG. 18 illustrates a configuration of a shift portion of a shift unit provided in a sheet processing apparatus according to a third exemplary embodiment.

Next, a third exemplary embodiment will be described. FIG. 18 illustrates the configuration of the shift portion 609 of the shift unit 600 provided in the sheet processing apparatus according to the present exemplary embodiment. As illustrated in FIG. 8, the shift portion 609 is provided with the shift motor M3 configured to perform a shifting operation, the belt 6092 wrapped around the pulley 6091 and the shift motor M3, and the slide member 6093 mounted to the belt 6092. Further, the shift portion 609 is provided with the drive motor M2 for rotating the conveyance roller pair 603 and the belt 6097 for transmitting the rotation of the drive motor M2 to the shaft 6098. These portions, however, are omitted in FIG. 18 for the sake convenience in illustration.

In FIG. 18, a gear 60911 for receiving rotational drive from the drive motor M2 is mounted to a conveyance roller shaft 60910. A conveyance belt 60914 is stretched around the conveyance roller shaft 60910 and pulleys 60915 and 60916 rotatably supported by a shaft supporting plate 60920 mounted to a guide 60912.

Above the pulleys 60915 and 60916, there are provided rollers 60918 and 60919 switched between contact and separation with respect to the conveyance belt 60914 by the separating mechanism 610 configured as described above. When the drive motor M2 rotates, the rotation is transmitted to the conveyance belt 60914 via the gear 60911 and the conveyance roller shaft 60910, so that the conveyance belt 60914 rotates, and the rollers 60918 and 60919 in contact with the conveyance belt 60914 also rotate.

Figure 19A:
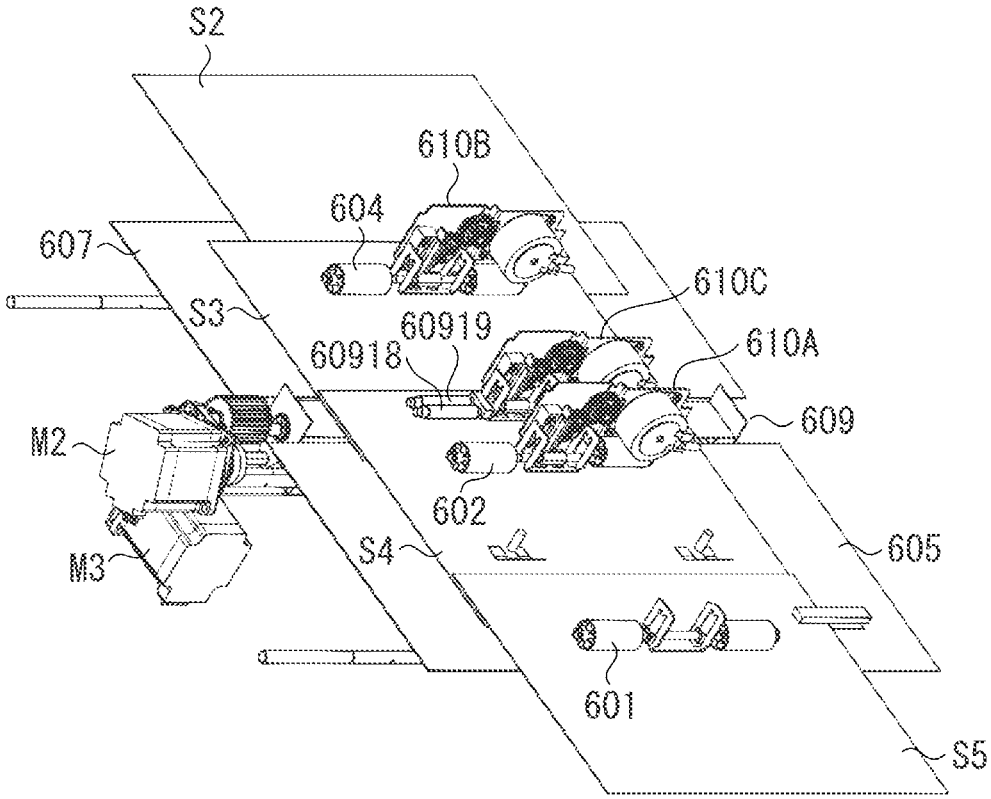
FIGS. 19A and 19B illustrate a sheet shifting operation of the above-mentioned shift unit.
Figure 19B:
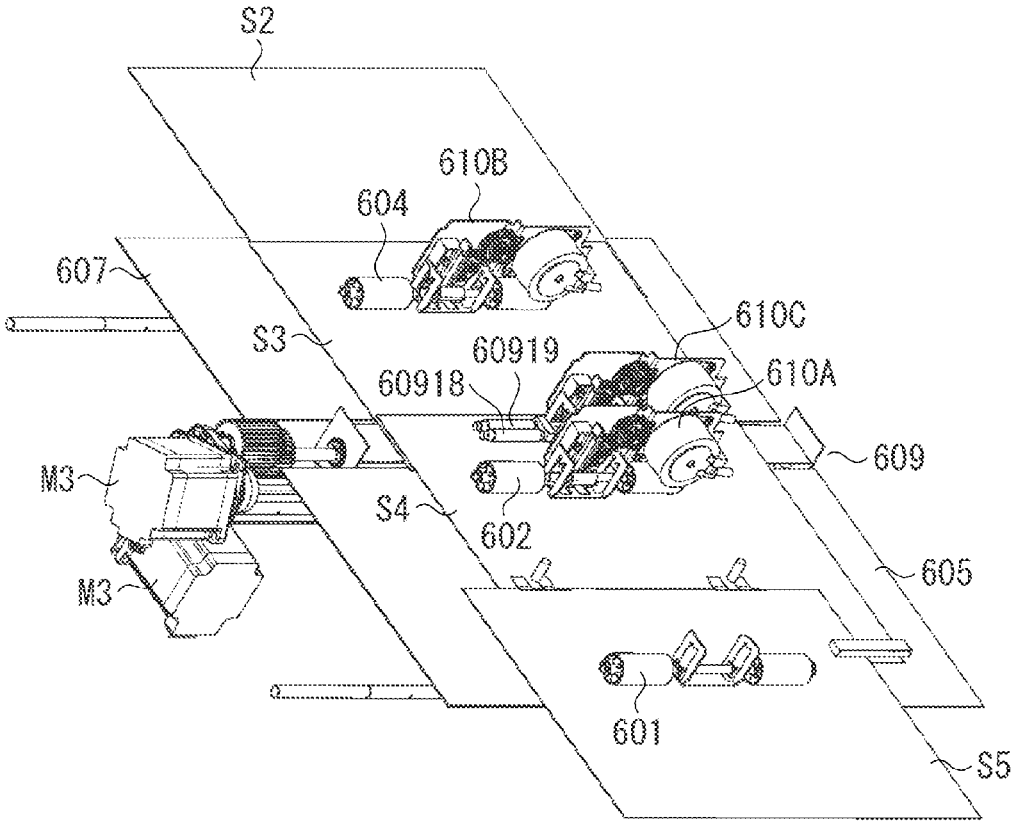

FIGS. 19A and 19B illustrate the sheet shifting operation of the shift unit 600 configured as described above. As illustrated in FIG. 19A, when the conveyed overlapping portion of the sheets S3 and S4 reaches the rollers 60918 and 60919, the first and second conveyance roller pairs 602 and 604 are placed in the separated state. Then, as illustrated in FIG. 19B, the shift portion 609 moves to the rear side from the initial position to move the sheets S3 and S4 to the same position as the sheet S2 which has already been shifted. After the shifting of the sheets is completed, the shift portion 609 moves to the initial position through the same operation as in the first exemplary embodiment described above, and stands by for the shifting of the following sheet. By repeatedly performing the above operation on the following sheets, the sheets are shifted for each sheet bundle and stacked on the tray 700.

According to the present exemplary embodiment, the shifting operation is performed while retaining the sheet overlapping portion in the conveyance direction by the two rollers 60918 and 60919, that is, while retaining the sheets at two positions (at a plurality of positions). By performing the shifting operation while retaining the sheet overlapping portion at a plurality of position, it is possible to perform a stable shifting operation, and changes in orientation of a sheet such as skewing or deviation of a sheet can be prevented at the time of shifting operation.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-069562 filed Mar. 26, 2012, which is hereby incorporated by reference herein in its entirety.

What is claimed is:

1. A sheet conveyance apparatus comprising:

a conveyance roller pair configured to be movable in a widthwise direction orthogonal to a sheet conveyance direction while conveying sheets in a state in which an upstream end portion in the sheet conveyance direction of a preceding sheet and a downstream end portion in the sheet conveyance direction of a following sheet overlap each other;

a movement mechanism configured to reciprocate the conveyance roller pair in the widthwise direction;

a detection unit provided upstream in the sheet conveyance direction of the conveyance roller pair and configured to detect an overlapping portion where the upstream end portion in the sheet conveyance direction of the preceding sheet and the downstream end portion in the sheet conveyance direction of the following sheet overlap each other; and a control unit configured to control the movement mechanism so as to move the conveyance roller pair in the widthwise direction in a case where it is determined that the sheet overlapping portion has reached the conveyance roller pair based on detection by the detection unit.

2. The sheet conveyance apparatus according to claim 1, further comprising:

a separating mechanism configured to place the conveyance roller pair in a separation state;

a first sheet conveyance unit provided upstream in the sheet conveyance direction of the conveyance roller pair and including a first conveyance roller pair placed in either a contact state or a separation state and configured to convey sheets having the overlapping portion and a first separating mechanism configured to place the first conveyance roller pair in the separation state; and a second sheet conveyance unit provided downstream in the sheet conveyance direction of the conveyance roller pair and including a second conveyance roller pair placed in either a contact state or a separation state and configured to convey sheets having the overlapping portion and a second separating mechanism configured to place the second conveyance roller pair in the separation state, wherein, based on detection by the detection unit, the control unit controls the first and second separating mechanisms to respectively place the first and second conveyance roller pairs in the separation state before the overlapping portion of the sheets reaches the conveyance roller pair, and to respectively place the first and second conveyance roller pairs in the contact state when movement of the conveyance roller pair in the widthwise direction is completed, and, wherein the control unit controls the separating mechanism to place the conveyance roller pair in the separation state in a case that the first and second conveyance roller pairs are respectively placed in the contact state, and controls the movement mechanism to return the conveyance roller pair to a position before the movement.

3. The sheet conveyance apparatus according to claim 2, further comprising:

a downstream conveyance roller pair provided downstream in the sheet conveyance direction of the second sheet conveyance unit and configured to be movable in the widthwise direction while conveying sheets having the overlapping portion; and a downstream movement mechanism configured to reciprocate the downstream conveyance roller pair in the widthwise direction, wherein, based on detection by the detection unit, the control unit controls the movement mechanism and the downstream movement mechanism to simultaneously move the conveyance roller pair and the downstream conveyance roller pair in the widthwise direction in a case where it is determined that an overlapping portion of a preceding sheet and a following sheet has reached the downstream conveyance roller pair and an overlapping portion of the following sheet and a next following sheet has reached the conveyance roller pair.

4. The sheet conveyance apparatus according to claim 3, further comprising:

a third sheet conveyance unit provided downstream in the sheet conveyance direction of the downstream conveyance roller pair and including a third conveyance roller pair placed in either a contact state or a separation state and configured to convey sheets having the overlapping portion and a third separating mechanism configured to place the third conveyance roller pair in the separation state, wherein the control unit controls the first separating mechanism, the second separating mechanism, and the third separating mechanism so as to respectively place the first conveyance roller pair, the second conveyance roller pair, and the third conveyance roller pair in the separation state before the overlapping portion of the preceding sheet and the following sheet reaches the downstream conveyance roller pair and before the overlapping portion of the following sheet and the next following sheet reaches the conveyance roller pair, and controls the movement mechanism and the downstream movement mechanism so as to simultaneously move the conveyance roller pair and the downstream conveyance roller pair in the widthwise direction while causing the downstream conveyance roller pair to convey the overlapping portion of the preceding sheet and the following sheet and causing by the conveyance roller pair to convey the overlapping portion of the following sheet and the next following sheet.

5. The sheet conveyance apparatus according to claim 4, further comprising:

a downstream separating mechanism configured to place the downstream conveyance roller pair in the separation state, wherein the control unit controls the first separating mechanism, the second separating mechanism, and the third separating mechanism to respectively place the first conveyance roller pair, the second conveyance roller pair, and the third conveyance roller pair in the contact state in a case where movement of the conveyance roller pair and the downstream roller pair in the widthwise direction is completed, and controls the separating mechanism and the downstream separating mechanism to place the conveyance roller pair and the downstream conveyance roller pair in the separation state in a case where the first conveyance roller pair, the second conveyance roller pair, and the third conveyance roller pair are placed in the contact state, and controls the movement mechanism and the downstream movement mechanism so as to return the conveyance roller pair and the downstream conveyance roller pair to respective positions before the movement.

6. The sheet conveyance apparatus according to claim 1, further comprising:

a side end detection unit provided upstream in the sheet conveyance direction of the conveyance roller pair and configured to detect a side end position in the widthwise direction of a conveyed sheet, wherein, based on a detection result of the side end detection unit, the control unit controls the movement mechanism to increase an amount of movement of the conveyance roller pair in the widthwise direction as a deviation of the side end position in the sheet widthwise direction becomes larger.

7. The sheet conveyance apparatus according to claim 1, further comprising:

a moving unit in which a plurality of the conveyance roller pairs are arranged in the sheet conveyance direction so as to move a plurality of sheets while holding an overlapping portion of the sheets at a plurality of positions in the sheet conveyance direction, wherein the movement mechanism moves the moving unit in the widthwise direction.

8. An image forming system comprising:

an image forming unit configured to form an image on a sheet;

a conveyance roller pair configured to be movable in a widthwise direction orthogonal to a sheet conveyance direction while conveying sheets in a state in which an upstream end portion in the sheet conveyance direction of a preceding sheet on which an image is formed and a downstream end portion in the sheet conveyance direction of a following sheet on which an image is formed overlap each other;

a movement mechanism configured to reciprocate the conveyance roller pair in the widthwise direction;

a detection unit provided upstream in the sheet conveyance direction of the conveyance roller pair and configured to detect an overlapping portion where the upstream end portion in the sheet conveyance direction of the preceding sheet and the downstream end portion in the sheet conveyance direction of the following sheet overlap each other;

a control unit configured to control the movement mechanism so as to move the conveyance roller pair in the widthwise direction in a case where it is determined that the sheet overlapping portion has reached the conveyance roller pair based on detection by the detection unit;

a sheet discharge unit configured to discharge a sheet moved while being changed a position in the widthwise direction every sheet bundle by the movement mechanism; and a tray on which the sheets discharged from the sheet discharge unit are stacked in a state in which the sheets are deviated in the widthwise direction.

9. The image forming system according to claim 8, further comprising:

a separating mechanism configured to place the conveyance roller pair in a separation state;

a first sheet conveyance unit provided upstream in the sheet conveyance direction of the conveyance roller pair and including a first conveyance roller pair capable of being placed in either a contact state or a separation state and configured to convey sheets having the overlapping portion and a first separating mechanism configured to place the first conveyance roller pair in the separation state; and a second sheet conveyance unit provided downstream in the sheet conveyance direction of the conveyance roller pair and including a second conveyance roller pair placed in either contact state or a separation state and configured to convey sheets having the overlapping portion and a second separating mechanism configured to place the second conveyance roller pair in the separation state, wherein, based on detection by the detection unit, the control unit controls the first and second separating mechanisms to respectively place the first and second conveyance roller pairs in the separation state before the overlapping portion of the sheets reaches the conveyance roller pair, and to respectively place the first and second conveyance roller pairs in the contact state when the movement of the conveyance roller pair in the widthwise direction is completed, and, wherein the control unit controls the separating mechanism to place the conveyance roller pair in the separation state in a case that the first and second conveyance roller pairs are respectively placed in the contact state, and controls the movement mechanism to return the conveyance roller pair to a position before the movement.

10. The image forming system according to claim 9 further comprising:

a downstream conveyance roller pair provided downstream in the sheet conveyance direction of the second sheet conveyance unit and configured to be movable in the widthwise direction while conveying sheets having the overlapping portion; and a downstream movement mechanism configured to reciprocate the downstream conveyance roller pair in the widthwise direction, wherein, based on detection by the detection unit, the control unit controls the movement mechanism and the downstream movement mechanism to simultaneously move the conveyance roller pair and the downstream conveyance roller pair in the widthwise direction in a case where it is determined that an overlapping portion of a preceding sheet and a following sheet has reached the downstream conveyance roller pair and an overlapping portion of the following sheet and a next following sheet has reached the conveyance roller pair.

11. The image forming system according to claim 10, further comprising:

a third sheet conveyance unit provided downstream in the sheet conveyance direction of the downstream conveyance roller pair and including a third conveyance roller pair being placed in a contact state and a separation state and configured to convey the sheets having the overlapping portion and a third separating mechanism configured to place the third conveyance roller pair in the separation state, wherein the control unit controls the first separating mechanism, the second separating mechanism, and the third separating mechanism so as to respectively place the first conveyance roller pair, the second conveyance roller pair, and the third conveyance roller pair in the separation state before the overlapping portion of the preceding sheet and the following sheet reaches the downstream conveyance roller pair and before the overlapping portion of the following sheet and the next following sheet reaches the conveyance roller pair, and controls the movement mechanism and the downstream movement mechanism so as to simultaneously move the conveyance roller pair and the downstream conveyance roller pair in the widthwise direction while causing the downstream conveyance roller pair to convey the overlapping portion of the preceding sheet and the following sheet and causing by the conveyance roller pair to convey the overlapping portion of the following sheet and the next following sheet.

12. The image forming system according to claim 11, further comprising:

a downstream separating mechanism configured to place the downstream conveyance roller pair in the separation state, wherein the control unit controls the first separating mechanism, the second separating mechanism, and the third separating mechanism to respectively place the first conveyance roller pair, the second conveyance roller pair, and the third conveyance roller pair in the contact state in a case where movement of the conveyance roller pair and the downstream roller pair in the widthwise direction is completed, and controls the separating mechanism and the downstream separating mechanism to place the conveyance roller pair and the downstream conveyance roller pair in the separation state in a case where the first conveyance roller pair, the second conveyance roller pair, and the third conveyance roller pair are placed in the contact state, and controls the movement mechanism and the downstream movement mechanism so as to return the conveyance roller pair and the downstream conveyance roller pair to respective positions before the movement.

13. The image forming system according to claim 8, further comprising:

a side end detection unit provided upstream in the sheet conveyance direction of the conveyance roller pair and configured to detect a side end position in the widthwise direction of a conveyed sheet, wherein, based on a detection result of the side end detection unit, the control unit controls the movement mechanism to increase an amount of movement of the conveyance roller pair in the widthwise direction as a deviation of the side end position in the sheet widthwise direction becomes larger.

14. The image forming system according to claim 8, further comprising:

a moving unit in which a plurality of the conveyance roller pairs are arranged in the sheet conveyance direction so as to move a plurality of sheets while holding an overlapping portion of the sheets at a plurality of positions in the sheet conveyance direction, wherein the movement mechanism moves the moving unit in the widthwise direction.

* * * * *